US011377172B2

(12) United States Patent
Wijning et al.

(10) Patent No.: US 11,377,172 B2
(45) Date of Patent: Jul. 5, 2022

(54) SEMI-SUBMERSIBLE DRILLING VESSEL, E.G. FOR USE IN A HARSH ENVIRONMENT

(71) Applicant: ITREC B.V., Schiedam (NL)

(72) Inventors: Diederick Bernardus Wijning, Schiedam (NL); Joop Roodenburg, Schiedam (NL)

(73) Assignee: ITREC B.V., Schiedam (NL)

( * ) Notice: Subject to any disclaimer, the term of this patent is extended or adjusted under 35 U.S.C. 154(b) by 28 days.

(21) Appl. No.: 16/970,758

(22) PCT Filed: Feb. 19, 2019

(86) PCT No.: PCT/NL2019/050108
§ 371 (c)(1),
(2) Date: Aug. 18, 2020

(87) PCT Pub. No.: WO2019/160420
PCT Pub. Date: Aug. 22, 2019

(65) Prior Publication Data

US 2021/0001954 A1 Jan. 7, 2021

(30) Foreign Application Priority Data

Feb. 19, 2018 (NL) ..... 2020457
Feb. 22, 2018 (NL) ..... 2020484

(51) Int. Cl.
*B63B 1/10* (2006.01)
*B63B 35/44* (2006.01)
(Continued)

(52) U.S. Cl.
CPC ..... *B63B 1/107* (2013.01); *B63B 35/4413* (2013.01); *E21B 7/122* (2013.01); *E21B 19/143* (2013.01)

(58) Field of Classification Search
CPC ..... B63B 1/107; B63B 35/4413; E21B 7/122; E21B 19/143; E21B 7/128; E21B 19/14
See application file for complete search history.

(56) References Cited

U.S. PATENT DOCUMENTS 8,590,474 B2 * 11/2013 Roodenburg ..... B63B 35/44 114/268
9,874,060 B2 * 1/2018 Roodenburg ..... E21B 19/008

FOREIGN PATENT DOCUMENTS

EP 0 228 907 A2 7/1987
WO WO 85/03050 A1 7/1985
(Continued)

OTHER PUBLICATIONS

Dutch Search Report, issued in Priority Application No. 2020457, dated Nov. 6, 2018.
(Continued)

*Primary Examiner* — Anthony D Wiest
(74) *Attorney, Agent, or Firm* — Birch, Stewart, Kolasch & Birch, LLP

(57) ABSTRACT

A semi-submersible drilling vessel has a deckbox structure, one or more pontoons, and multiple support columns extending upward from the one or more pontoons and supporting thereon the deckbox structure. An annular riser joints storage caisson extends downwardly from the deckbox structure, wherein the storage caisson delimits an annular storage space configured for storage therein of an annular array of riser joints in vertical orientation thereof. A riser joints carousel device is provided in the annular storage space, which riser joints carousel device is configured to carry an annular array of riser joints in vertical orientation thereof in a mobile manner relative to the annular storage caisson so that the array of riser joints is movable along an annular path through the storage spaced between the inner and outer wall of the storage caisson. The deckbox structure
(Continued)

Figure 1A:
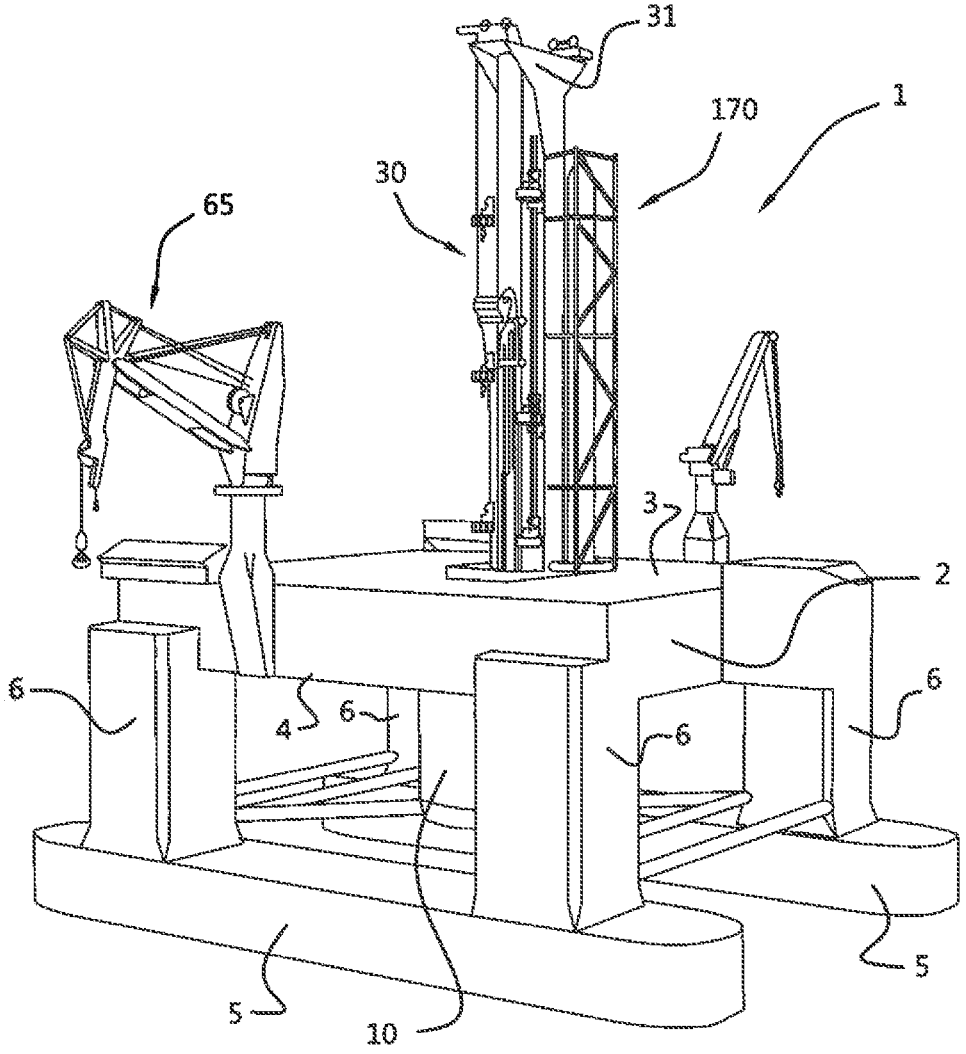

is provided with a riser joint transfer passage at a riser joint transfer location above the annular path of the riser joints carried by the riser joints carousel device through the storage space. The vessel is provided with a riser joint vertical transfer device configured to lift and lower a riser joint out of and into the riser joints carousel device, passing therein vertically through the riser joint transfer passage of the deckbox structure.

12 Claims, 17 Drawing Sheets

(51) Int. Cl.
*E21B 7/12* (2006.01)
*E21B 19/14* (2006.01)

(56) References Cited

FOREIGN PATENT DOCUMENTS

WO WO 2010/126357 A1 11/2010
WO WO 2016/062812 A1 4/2016

OTHER PUBLICATIONS

International Search Report, issued in PCT/NL2019/650108, dated Jun. 25, 2019.
Written Opinion of the International Searching Authority, issued in PCT/NL2019/050108, dated Jun. 25, 2019.

* cited by examiner

SEMI-SUBMERSIBLE DRILLING VESSEL, E.G. FOR USE IN A HARSH ENVIRONMENT

The present invention relates to the field of semi-submersible drilling vessels. Generally the hull of a semi-submersible drilling vessel has a deckbox structure with an upper deck and a box bottom. Further the hull has one or more pontoons, e.g. two parallel pontoons or a ring pontoon, and multiple support columns that extend upward from the one or more pontoons and support thereon the deckbox structure. A semi-submersible drilling vessel further comprises a drilling installation with a drilling tower, e.g. a mast or a derrick, erected above the upper deck of the deckbox structure and adapted to perform drilling operations along at least one firing line through the moonpool in the deckbox structure.

In WO85/03050 a quite distinctive embodiment of a semi-submersible is disclosed. Therein the buoyant hull also includes, in a central region of the deckbox structure, an annular riser joints storage caisson that protrudes downwardly from the deckbox structure, spaced from each of the support columns. This storage caisson has an inner wall, an outer wall, and a storage caisson bottom. The storage caisson delimits an annular storage space configured for storage therein of an annular array of riser joints in vertical orientation thereof.

A vessel according to WO85/03050 is called Jack Bates and was built in 1986. The vessel has a derrick placed on the upper deck and over the top end of the storage caisson. The seagoing behaviour of this vessel is, as explained in the PCT document, very stable with marginal heave motion even in adverse weather conditions.

The present invention aims to provide an improved semi-submersible vessel.

The present invention achieves this aim by providing a vessel according to the preamble of claim 1, wherein a riser joints carousel device is provided in the annular storage space, which riser joints carousel device is configured to carry the annular array of riser joints in vertical orientation thereof in a mobile manner relative to the annular storage caisson so that said array of riser joints is movable along an annular path through the storage spaced between the inner and outer walls of the storage caisson, wherein the deckbox structure is provided with a riser joint transfer passage at a riser joint transfer location above the annular path of the riser joints carried by the riser joints carousel device through the storage space, and wherein the vessel is provided with a riser joint vertical transfer device configured to lift and lower a riser joint out of and into the riser joints carousel device, passing therein vertically through the riser joint transfer passage of the deckbox structure.

By provision of the riser joints carousel device it is possible to align a selected riser joint stored therein with the riser joint transfer passage at the riser joint transfer location and then lift the selected riser joint out of the carousel device. For example just one such riser joint transfer passage at just one riser joint transfer location is provided on the vessel.

The storage space for the riser joints is preferably are arranged with its upper end, e.g. formed in part by a roof over the storage space, at a distance below the upper deck of the deckbox structure, most preferably below the lowermost deck of the deckbox structure, even more preferably below the bottom of the deckbox structure. So, contrary to the disclosure of WO 85/03050, it is envisaged that the riser joints storage space does not extend through the deckbox structure up till the upper deck. Instead the top of the storage space is below the upper deck and a riser joint transfer passage extends through, at least a part of, the height of the deckbox structure.

In an embodiment the riser joints storage caisson is substantially cylindrical with circular cross-section inner and outer walls defining the storage space between them. Of course a polygonal cross-section may be provided to approximate a substantially cylindrical design of the caisson.

Whilst a cylindrical design with concentric inner and outer walls of the storage caisson is preferred, e.g. in view of having a circular path of the carousel device, other cross-sectional shapes of the caisson may be provided as well. For example an oval shape, e.g. with a main axis of the oval parallel to parallel pontoons of the vessel.

Preferably the bottom of the storage caisson is located above the transit waterline of the vessel, so that the caisson does not drag through the water during transit.

For example the vessel has four supporting columns, wherein the caisson is located in the center between the columns, e.g. with a diagonal brace between the caisson and each of the columns.

In an embodiment the riser joints carousel device comprises a series of riser joint carriers, e.g. runner over a rail track with one or more rails, that are each adapted to carry at least one, or preferably just one, riser joint in vertical orientation thereof. So for example a wheeled carrier is arranged on or near the bottom of the storage space of the caisson, configured to support one riser joint thereon in vertical orientation. In an embodiment the riser joint carriers are linked, e.g. by hinges and/or chains and/or cables, etc. to form an annular unit. For example a drive is provided for such an annular unit of riser joint carriers. In another embodiment individual riser joint carriers or groups of multiple riser joint carriers are provided with a drive to move the riser joint carriers through the annular storage caisson along the annular path between the inner and outer wall.

In an embodiment the carousel device comprises a series of lower riser joint carries configured to support one or more riser joints at a lower end thereof, and a series of upper riser joint carriers configured to support one or more riser joints at an elevated position, e.g. at or near the top end of the riser joint.

In an embodiment the carousel device comprises a tubular riser joint storage member that is open at the top to allow for transfer of a riser joint into and out of the tubular riser storage member via said open top.

In an embodiment the deckbox structure comprises, in vertical projection above the annular storage space of the storage caisson and adjoining the moonpool, one or more wireline riser tensioner equipment rooms accommodating therein wireline riser tensioner equipment, e.g. comprising vertically oriented wireline riser tensioner cylinders, that is configured to provide top tension to a riser that has been assembled use riser storage joints taken from the riser storage caisson of the vessel. As preferred these rooms are below the upper deck adjoining the moonpool, e.g. said area of the upper deck being flush with a mobile working deck above the moonpool as will be explained herein. So the invention provides for the option to have the wireline riser tensioner equipment close to the moonpool, effectively above the storage space for the riser joints, with the riser joint transfer passage not interfering with the riser tensioner equipment. It will be appreciate that, in an embodiment, the vessel may also, or as an alternative to wireline riser tensioner system, be equipped with a riser tensioner system with direct acting riser tensioner cylinders as is known in the art.

In an embodiment the deckbox structure comprises, in vertical projection above the annular storage space of the storage caisson and adjoining the moonpool, a subsea BOP (Blow Out Preventer) storage room, e.g. on a lower deck of the deckbox structure, e.g. the lowermost deck of the deckbox structure. Herein a set of BOP handling cart rails is provided, e.g. skid rails, extending from the subsea BOP (Blow Out Preventer) storage room towards and along opposed sides of the moonpool. Herein the vessel is provided with a BOP handling cart travelling over said BOP handling cart rails so as to allow for transfer of a subsea BOP (Blow Out Preventer) between the BOP storage room and a position aligned with the firing line. The BOP may be, as often seen in practice, be a tall BOP with an upper portion thereof sticking out above the upper deck of the deckbox. This is for example envisaged in combination with a vertically mobile working deck over the moonpool, that in an elevated position thereof allows for bringing the tall BOP underneath the working deck in alignment with the firing line.

The BOP storage room is preferably in open communication with the moonpool and through one or more vent openings in the roof and/or sidewalls of the room with the exterior e.g. above the upper deck, so as to allow for continuous venting of the moonpool, e.g. in view of an air piston effect caused by the wave action of the water within the lower section of the moonpool formed by the caisson. Due to the continuous venting via the BOP storage room, and/or via an alternative route through the deckbox structure, an undesired built-up of air pressure and resulting air motion is prevented effectively.

In an embodiment the deckbox structure comprises, in vertical projection above the annular storage space of the storage caisson and adjoining the moonpool, a spoolable product coil devices room accommodating therein one or more coil devices, each having a coil storing thereon a spoolable product, such as a (control) line, wireline, cable, hose, coiled-tubing, umbilical, etc. Preferably this room is open towards the moonpool, allowing to pass the one or more spoolable products from the respective coil device to the firing line, e.g. an umbilical that is to be attached to the exterior of the riser.

In an embodiment the vessel is provided with a mobile working deck which is arranged in vertical projection above the moonpool, which working deck is vertically movable, e.g. by one or more hydraulic cylinder arranged between the working deck and the deckbox structure.

In an embodiment the working deck is in a lower stationary resting position thereof flush with at least an adjoining area of the upper deck of the deckbox structure. Preferably herein the working deck and the adjoining area of the upper deck of the deckbox structure are provided with rail tracks configured to transfer equipment over said rail tracks, e.g. equipment arranged on a skid pallet skiddable over said rail tracks, onto and off the working deck.

In an embodiment the working deck is configured to be elevated relative to a stationary resting position thereof, e.g. flush with an adjoining area of the upper deck, and to be movable within a motion range including a heave compensation motion range.

Preferably, at least one of a drill string slip device, a riser spider device, and/or a diverter is supported by the mobile working deck, wherein said drill string slip device is configured to support a suspended drill string within a riser, wherein the riser spider device is configured to support a suspended riser, e.g. during assembly and disassembly of a riser, and wherein the diverter is configured to divert a hydrocarbon and/or drilling mud stream from a subsea wellbore to the vessel.

In an embodiment multiple vertically mounted working deck compensator cylinders are arranged between the deckbox structure and the mobile working deck, e.g. two sets of multiple compensator cylinders, e.g. two pairs, supporting the mobile working deck. Preferably the working deck compensator cylinders are configured to provide a heave compensated motion of the working deck relative to the deckbox structure.

In an embodiment a first set of working deck compensator cylinders is arranged outward of a first BOP handling cart rails, relative to the moonpool, and a second set of working deck compensator cylinders is arranged outward of a second BOP handling cart rails, relative to the moonpool, so as to allow for passing a subsea BOP on a BOP handling cart in between the first and second set of working deck compensator cylinders. For example the working deck compensator cylinders are extendable to raise the working deck from its stationary resting position into an elevated position so as to allow for passage of the subsea BOP from the BOP storage room into the firing line underneath the elevated working deck. As preferred working deck compensator cylinder not only allow for raising and lowering of the working deck but also for heave compensation motion of the working deck, e.g. with a riser connected via a locked, or non-locked, telescopic joint to the working deck.

In an embodiment a first set of vertically oriented wireline riser tensioner cylinders is arranged outward of a first set of working deck compensator cylinders, relative to the moonpool, and a second set of vertically oriented wireline riser tensioner cylinders is arranged outward of a second set of working deck compensator cylinders, relative to the moonpool. This allows for a compact arrangement of the compensator cylinders and the wireline riser tensioner cylinders, e.g. with sheave of the wirelines to the tensioner ring being arranged in proximity of the working deck compensator cylinders.

In an embodiment multiple vertically mounted working deck compensator cylinders are secured at a lower end thereof to a lower deck of the deckbox structure, e.g. the lowermost deck of the deckbox structure.

In an embodiment, the mobile working deck compensator comprises in series:

- a lift cylinder, configured to lift the mobile working deck out of the stationary resting position and to move the mobile working deck between the lowered position and an elevated position, and
- a heave compensation cylinder, configured to provide a heave compensated motion of the mobile working deck when lifted in the elevated position by the lift cylinder, moving the mobile working deck between a heave compensation maximum height position and a heave compensation minimum height position.

This arrangement allows for a relatively reduced length of the heave compensation cylinder, or cylinders, as this cylinder(s) only has to have a stroke length attuned to the expected heave motion compensation. The lifting of the mobile working deck to the elevated position for example avoids any risk of the working deck reaching its stationary resting position during heave motion operation, and for example allows for passing of lines, pipes, etc. from underneath the working deck, e.g. from the diverter and/or a rotary control device (RCD) to locations outside of the moonpool, e.g. onto the upper deck.

For example a single lift cylinder supports two heave compensation cylinders, e.g. the single lift cylinder in between the two heave compensation cylinders.

For example a working lift cylinder is secured with a rod directed downwards, and each heave compensation cylinder is secured with its cylinder body to the cylinder body of the lift cylinder, e.g. via a frame, and has its rod directed upward to the working deck.

In an embodiment the tower is embodied as a vertical mast structure erected above the upper deck of the deckbox structure and adjacent a side of the moonpool, the vertical mast structure being located outside of the vertical projection of the moonpool so as to allow for optimal movement of objects out of and into the moonpool. This in contrast to a derrick mounted with its derrick structure over the moonpool as in the mentioned Jack Bates vessel.

Preferably the vertical mast structure is arranged in vertical projection above the storage space of the riser storage caisson, so as to be close to the moonpool which is favorable in view of the (bending) loads on the mast structure during hoisting of objects in the firing line.

Preferably a crown block structure is mounted on top of the vertical mast structure, e.g. supporting a set of crown block sheaves that guide a winch driven cable from which a travelling block is suspended, the travelling block having a set of sheaves for said cable.

In an embodiment the mast structure has an operative face directed towards the firing line through the moonpool.

In an embodiment the drilling installation further comprises a firing line associated hoisting device comprising at least one winch and at least one winch driven cable, which hoisting device is adapted to suspend a load from a crown block structure via said at least one winch driven cable and to manipulate a suspended load in the firing line, e.g. that extends along and outside of an operative face of the vertical mast structure.

In an embodiment the riser joint transfer passage is arranged in proximity of the vertical mast structure.

In an embodiment the riser joint transfer device is embodied as a crane arranged on the vertical mast structure, the crane being configured to lift and lower a riser joint through the riser joint transfer passage.

In an alternative design the vessel has a crane distinct from the drilling installation, e.g. a general purpose crane onboard the vessel, that has the capability to lift and lower a riser joint through the riser joint transfer passage.

In an alternative design the vessel has an elevator device arranged within the storage caisson and configured to engage, e.g. clamp, a riser joint and to lift and lower the engaged riser joint. For example an elevator device comprises one or more vertical rails extending through the transfer passage and into the caisson, with one or more vertically mobile riser joint engaging members, e.g. clamps, travelling over said one or more vertical rails by means of a corresponding drive, wherein the one or more members and drive are configured to support the weight of a riser joint.

In an embodiment the vertical mast structure is located in vertical projection above the storage space of the riser storage caisson and the riser joint transfer passage is arranged, seen in plan view onto the upper deck, within a 90° sector of the storage caisson relative to the mast. This for example allows for optimal use of deck space without interference of by handling of the riser joints. It also allows for optimal use of space in the deckbox in the vicinity of the moonpool.

In an embodiment BOP handling rails, e.g. on a lower or lowermost deck of the deckbox structure, are arranged perpendicular to an operative face of a vertical mast structure of the drilling installation.

In an embodiment the mast structure is provided, in proximity of the riser joint transfer passage, with a vertical motion arm assemblies rail, wherein at least one, e.g. multiple, motion arm assembly is mounted on said vertical motion arm assemblies rail, each motion arm assembly having a base that is vertically mobile along said vertical motion arm assemblies rail and an extensible, e.g. telescopic, arm that is mounted via a vertical axis slew bearing on said base so as to allow for extension and retraction of said arm as well as slewing motion of said arm about said vertical slew axis, wherein said arm is adapted to support a tool at an end of said arm, for example a riser joint engagement tool, e.g. said riser joint engagement tool being configured to assist in transfer of a riser joint between a position thereof aligned with the firing line and a position aligned with the riser joint transfer passage.

In an embodiment the riser joint transfer passage is arranged is arranged at one lateral side of the mast structure, and wherein the vessel is provided with a drilling tubulars storage rack, e.g. multi-joint drill pipe stands storage rack, e.g. a rotary storage rack, at an opposed lateral side of the mast structure, which drilling tubulars storage rack is adapted for storage of drilling tubulars in vertical orientation therein, and wherein the vessel, e.g. the mast structure, is provided with a racker system that is adapted to move a drilling tubular between the storage rack and a position aligned with the firing line.

In an embodiment the racker system comprises a vertical motion arm assemblies rail, wherein at least one, e.g. multiple, motion arm assembly is mounted on said vertical motion arm assemblies rail, each motion arm assembly having a base that is vertically mobile along said vertical motion arm assemblies rail and an extensible, e.g. telescopic, arm that is mounted via a vertical axis slew bearing on said base so as to allow for extension and retraction of said arm as well as slewing motion of said arm about said vertical slew axis, wherein said telescopic arm is adapted to support a tubulars gripper tool at an end of said arm, so as to allow for gripping of a drilling tubulars by means of the tubular gripper tool.

In an embodiment the vessel is provided with a drilling tubulars storage rack that is mounted on the deckbox structure, e.g. multi-joint drill pipe stands storage rack, e.g. a rotary storage rack, which drilling tubulars storage rack is adapted for storage of drilling tubulars in vertical orientation therein, and wherein the vessel, e.g. the mast structure, is provided with a racker system that is adapted to move a drilling tubular between the storage rack and a position aligned with the firing line, and wherein the racker system is heave compensated and is configured to bring a drilling tubular removed from the storage rack in a heave compensation motion that is synchronized with the heave compensation motion of the mobile working deck, e.g. wherein the racker comprises a vertical motion arm assemblies rail, wherein at least one, e.g. multiple, motion arm assembly is mounted on said vertical motion arm assemblies rail, each motion arm assembly having a base that is vertically mobile along said vertical motion arm assemblies rail by a drive configured to provide said heave compensation motion that is synchronized with the heave compensation motion of the mobile working deck, each motion arm assembly further having an extensible, e.g. telescopic, arm that is mounted via a vertical axis slew bearing on said base so as to allow for extension and retraction of said arm as well as slewing motion of said telescopic arm about said vertical slew axis, wherein said arm is adapted to support a tubulars gripper tool at an end of said arm, so as to allow for gripping of a drilling tubulars by means of the tubular gripper tool.

In an embodiment the vessel is provided with a mobile working deck which is arranged in vertical projection above the moonpool, which working deck is movable, e.g. vertically movable. The working deck, in a lower stationary resting position thereof, is flush with at least an adjoining area of the upper deck of the deckbox structure, wherein said working deck and said adjoining area of the upper deck of the deckbox structure are provided with rail tracks configured to transfer equipment over said rail tracks, e.g. equipment arranged on a skid pallet skiddable over said rail tracks, onto and off the working deck. In an embodiment the rail tracks comprise a section that extend between the riser joint transfer passage and the working deck, wherein the vessel comprises a riser joint cart travelling over said section of the rail tracks and configured to support a riser joint thereon in vertical orientation for transfer thereof between a position above the upper deck and aligned with the riser joint transfer passage on the one hand and a position aligned with the firing line on the other hand.

Instead, or in combination, with the use of a riser joint cart for displacement of a riser joint between a position aligned with the riser transfer passage and a position aligned with the firing line, one can also envisage the use of a crane, e.g. to maintain the riser joint in upright position during the travel of the riser joint cart between said position. Maintaining an upright position of the riser joint standing on a cart can also be causes, in embodiments, by engaging the riser joint at an elevated position, e.g. at or near the top end thereof, by means of a motion arm, e.g. of a vertical motion arm assembly as described herein, e.g. a motion arm mounted on a vertical mast structure.

In an embodiment a motion arm assembly is embodied as a crane having the capability to lift and lower a riser joint via the riser joint transfer passage.

In an embodiment the vessel comprises a drilling tubulars rotary storage rack that is rotatable about a vertical axis and has storage slots for storage of multiple drilling tubulars in vertical orientation, the drilling tubulars rotary storage rack including a drive to rotate the drilling tubulars storage rack about its vertical axis, for example said drilling tubulars rotary storage rack comprising a central vertical post and multiple discs at different heights on the post, at least one disc being a fingerboard disc having tubulars storage slots, each slot having an opening at an outer circumference of the fingerboard disc allowing to introduce and remove a tubular from the storage slot.

In an embodiment the tower is embodied as a vertical mast structure erected above the upper deck of the deckbox structure and adjacent a side of the moonpool, wherein the mast structure, e.g. at an operative face thereof directed towards the firing line through the moonpool, is provided with one or more vertical guide rails, and wherein the drilling installation comprises a travelling device that is movable up and down along and outside of said operative face of the mast and guided by said one or more vertical guide rails of said mast, e.g. wherein said travelling device is suspended from a winch driven cable, e.g. suspended from a crown block structure of the tower, e.g. the travelling device being suspended from a travelling block, e.g. wherein the travelling device is adapted to suspend a load from said travelling device and/or to support the travelling block.

In an embodiment the tower is embodied as a vertical mast structure erected above the upper deck of the deckbox structure and adjacent a side of the moonpool, wherein the mast structure, e.g. at an operative face thereof directed towards the firing line through the moonpool, is provided with one or more vertical guide rails, and wherein the drilling installation comprises a travelling device that is movable up and down along and outside of said operative face of the mast and guided by said one or more vertical guide rails (15) of said mast, and wherein the inner wall of the riser storage caisson is provided with one or more caisson mounted vertical guide rails which form a continuation of said one or more guide rails of mast, e.g. said one or more guide rails extending to a lower opening of the riser storage caisson.

In an embodiment the tower is embodied as a singular vertical mast structure having closed wall contour, e.g. an octagonal cross-section, e.g. over at least a major portion of the height of the tower.

In an embodiment the drilling installation further comprises a firing line hoisting device comprising at least one winch and at least one winch driven cable, which hoisting device is adapted to suspend a load from said crown block structure via said at least one winch driven cable and to manipulate a suspended load in the firing line of the drilling installation, which firing line extends along and outside of an operative face of a vertical mast structure of the tower, and wherein the tower is provided with one or more heave compensation cylinders acting on one or more cable sheaves along with the winch driven cable passes in order to provide heave compensation functionality for the load suspended in the firing line. In addition to the heave compensation cylinders and/or as an alternative the winch may be embodied as an active heave compensated winch as is known in the art.

In an embodiment the vessel has a catwalk machine arranged on the upper deck configured to feed and remove drilling tubulars to and from a stand building line that is remote from the firing line of the tower.

In an embodiment the vertical tower is configured to perform subsea wellbore related operations and has a single vertical operative face that is directed towards the moonpool. On this operative face a pair of vertical guide rails is mounted and a travelling device, e.g. a trolley, is provided that is movable up and down along and outside of this operative side of the tower and guided by these vertical guide rails of the tower. The tower is provided with a winch and a winch driven cable, which passes from a crown block structure with one or more cable sheaves at the top of the tower down along a firing line of the tower. In an embodiment the travelling device mostly serves to guide this cable and a load in the firing line, e.g. mating with a load connector as a load is lifted out of the water. In another embodiment the travelling device is suspended from the winch driven cable and the travelling device is adapted to suspend a load from the travelling device. In each case the hoisting device which comprises the winch and winch driven cable is adapted to suspend a load from the vertical tower via the winch driven cable and to manipulate the suspended load the firing line of the tower that extends along and outside of said vertical operative face of the tower.

In an embodiment the tower is provided at an operative side with one or more vertical guide rails and a travelling device, e.g. a trolley, is provided that is movable up and down along and outside of the operative side of the tower and guided by the one or more vertical guide rails of the tower. The travelling device can for example be a trolley. The travelling device may comprise one or more sets of guide rollers engaging the one or more guide rails. For example the travelling device is suspended from the winch driven cable and the travelling device is adapted to suspend a load from said travelling device.

In an embodiment the tower is embodied as a mast having a closed wall contour, e.g. over at least a major portion of the height of the tower, for example over a lower major portion with a top portion being embodied as a latticed structure or over the entire height of the tower.

In another embodiment the tower is embodied as a mast having a latticed structure, e.g. over at least a major portion of the height of the tower, e.g. over the entire height of the tower. For example an operative side facing the firing line is cladded with a panel so as to avoid any entanglement of components and/or loads in the latticed structure during manipulation activities with the hoisting device.

In an embodiment the winch of the hoisting device is mounted on the tower, e.g. inside the closed wall contour or on a side of the tower, e.g. on a side opposite the operative side and to the outside thereof. In the latter design the weight of the one or more winches may be employed as a counterweight for the load in the firing line of the tower. In another design the winch is mounted in the hull, e.g. in the deckbox structure.

In an embodiment the vessel is provided with a top drive device as commonly used in drilling operations. For example the top drive device is connected or connectable to the travelling device on the tower. The top drive device comprises one or more motors to provide torque to a rotary output quill that is connectable to a drilling tubulars string as is known in the art.

The present invention also relates to a method of performing a subsea wellbore related operation, e.g. a drilling and/or wellbore intervention operation and/or installation of wellbore related subsea equipment, wherein use is made of a vessel as described herein.

The present invention also relates to a method for assembly of a riser from a vessel as described herein, wherein the method comprises the step of operating the carousel device in order to align a selected riser joint stored therein with the riser joint transfer passage, followed by lifting said selected riser joint out of the carousel device and via the riser joint transfer passage to a position above the upper deck, and by moving said selected riser joint from said position to a position aligned with the firing line of the drilling installation.

A second aspect of the invention relates to a drilling vessel having a buoyant hull, e.g. a semi-submersible drilling vessel according to the preamble of claim 1, wherein the buoyant hull has a moonpool, an upper deck, and a drilling installation with a drilling tower that is erected above the upper deck of the deckbox structure, which drilling installation is adapted to perform drilling operations along at least one firing line through the moonpool, wherein adjoining the moonpool a subsea BOP (Blow Out Preventer) storage room, e.g. on a lower deck of the deckbox structure, e.g. the lowermost deck of the deckbox structure, is provided, and wherein a set of BOP handling cart rails is provided, e.g. skid rails, extending from the subsea BOP (Blow Out Preventer) storage room towards and along opposed sides of the moonpool, and wherein vessel is provided with a BOP handling cart that travels over said BOP handling cart rails so as to allow for transfer of a subsea BOP (Blow Out Preventer) between the BOP storage room and a position aligned with the firing line.

In the second aspect of the invention the vessel is provided with a mobile working deck which is arranged in vertical projection above the moonpool, which working deck is vertically movable, which working deck in a lower stationary resting position thereof is flush with at least an adjoining area of the upper deck, preferably wherein said working deck and said adjoining area of the upper deck of the deckbox structure are provided with rail tracks configured to transfer equipment over said rail tracks, e.g. equipment arranged on a skid pallet skiddable over said rail tracks, onto and off the working deck.

In the second aspect of the invention the working deck is configured to be elevated relative to said stationary resting position and to be movable within a motion range including a heave compensation motion range. Preferably, at least one of a drill string slip device, a riser spider device, and/or a diverter is supported by the mobile working deck.

In the second aspect of the invention multiple vertically mounted working deck compensator cylinders are arranged between the deckbox structure and the mobile working deck, e.g. two sets of multiple compensator cylinders, e.g. two pairs, supporting the mobile working deck, wherein said working deck compensator cylinders are configured to provide a heave compensated motion of the working deck relative to the deckbox structure.

In a preferred embodiment of the second aspect of the invention a first set of working deck compensator cylinders is arranged outward of a first BOP handling cart rail, relative to the moonpool, and a second set of working deck compensator cylinders is arranged outward of a second BOP handling cart rail, relative to the moonpool, so as to allow for passing a subsea BOP on the BOP handling cart in between the first and second set of working deck compensator cylinders, e.g. said working deck compensator cylinders being extendable to raise the working deck from its stationary resting position to allow for passage of the subsea BOP from the BOP storage room into the firing line.

In an embodiment of the second aspect of the invention a first set of vertically oriented wireline riser tensioner cylinders is arranged outward of the first set of working deck compensator cylinders, relative to the moonpool, and wherein a second set of vertically oriented wireline riser tensioner cylinders is arranged outward of the second set of working deck compensator cylinders, relative to the moonpool.

It will be appreciated that the vessel of the second aspect of the invention may be a semi-submersible vessel. However the second aspect of the invention is also applicable to, for example, a monohull drilling vessel.

The vessel of the second aspect of the invention may further include one or more of the technical features discussed herein with reference to the first aspect of the invention.

The second aspect of the invention also relates to a method of performing a subsea wellbore related operation, e.g. a drilling and/or wellbore intervention operation and/or installation of wellbore related subsea equipment, wherein use is made of a vessel as described with reference to the second aspect of the invention.

The second aspect of the present invention also relates to a method for assembly of a riser from a vessel according to the second aspect of the invention, which method comprises moving the BOP from the BOP storage room to a position aligned with the firing line through the moonpool, wherein the BOP sticks out above the upper deck when stored, and possibly assembled, in the BOP storage room, wherein the method comprising lifting the mobile working in order to allow for travel of the BOP on the respective BOP handling cart towards the moonpool and underneath the working deck into a position aligned with the firing line.

Figure 10A:
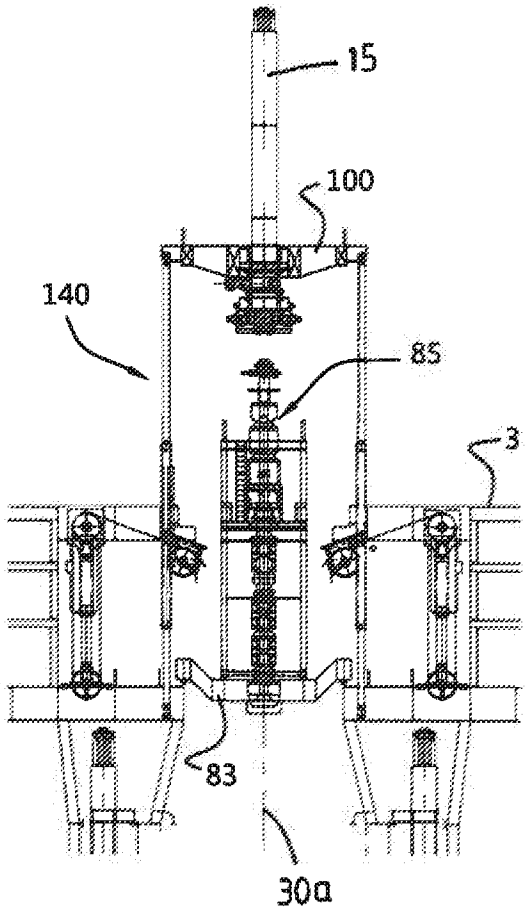
Figure 10B:
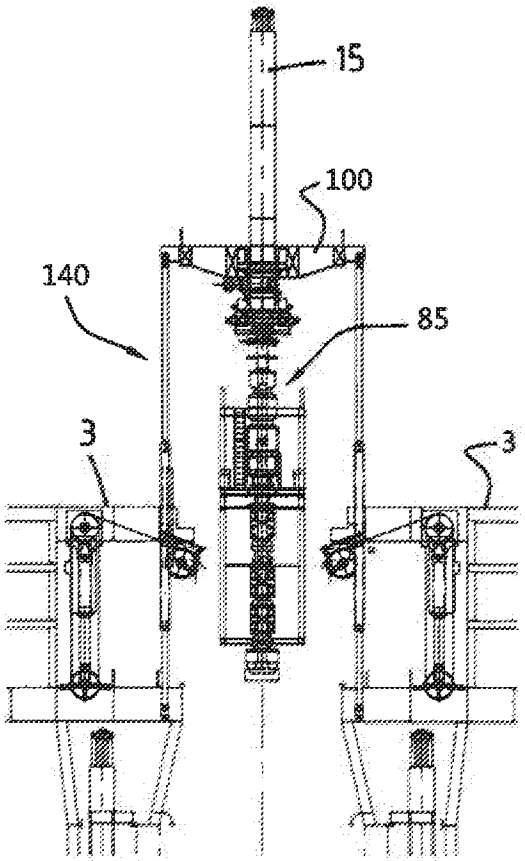

In a further embodiment of said method discussed above, the working deck is used to retain a first riser joint to be joined on top of the BOP as shown in FIG. 10*a* and to lower the working deck to mate said first riser joint to the BOP. As preferred the working deck is then raised to lift the BOP of the cart and the cart is moved back into the storage room. This allows for lowering the working deck 100 into the lower resting position thereof and extension of the riser by adding riser joints in a manner known in the art (e.g. the working deck supporting a riser spider device to support the riser during said assembly).

A third aspect of the invention relates to a drilling vessel having a buoyant hull, e.g. a semi-submersible drilling vessel according to the preamble of claim 1, wherein the buoyant hull has a moonpool, an upper deck, and a drilling installation with a drilling tower that is erected above the upper deck of the deckbox structure, which drilling installation is adapted to perform drilling operations along at least one firing line through the moonpool.

In the third aspect of the invention the vessel is provided with a riser tensioning buoyancy can, preferably an air can having compartment(s) filled with air, e.g. a controllable volume of air in order to adjust the buoyancy provided by the air can, that is configured to be secured to an upper portion of a subsea riser, e.g. in view of reducing the requirements of the wireline riser tensioner system of the vessel.

For example the air can has an annular air can body with a central vertical bore that is adapted to receive therein a riser joint of the vessel For example the bore has a diameter of at least 1.40 meters, e.g. between 1.40 and 2 meters.

In an embodiment the air can is cylindrical having an outer diameter between 4 and 9 meters, e.g. of 5 or 7.5 meters.

In an embodiment the air can is to be installed in the riser string directly below a telescopic joint, e.g. over the riser joint that is mounted directly below the telescopic joint. In another embodiment a further BOP device is mounted directly below the telescopic joint, with the air can being mounted directly below said further BOP device.

For example the air can has a height between 15 and 25 meters, e.g. approximately 18 or 20 meters, e.g. shorter than the length of a riser joint stored onboard the vessel, e.g. in a storage caisson, e.g. in an associated carousel device, of the vessel.

For example the air can is embodied to provided, when fully submerged, provide a top tension to the riser of at least 200 mt, e.g. more than 250 mt, possibly even more than 500 mt.

Preferably the vessel is embodied to store the air can at a location directly adjacent the moonpool, e.g. close to a BOP storage room. For example the air can is arranged on the same deck as the BOP. In an embodiment the air can is to be handled by a general purpose crane of the vessel or in the alternative arranged on a cart that is movable over associated rail track between a storage position adjacent the moonpool and a position aligned with the firing line.

In embodiment of the third aspect of the invention the vessel has a deck in the deckbox structure, e.g. the lowermost deck, whereon both a BOP and an air can are stored, e.g. both the BOP and the air can being so tall that they stick out above the upper deck of the vessel.

As will be appreciated it is preferred for a mobile working deck to be liftable to a height that allows to move the air can into a position underneath the deck and aligned with the firing line.

In an embodiment, adjoining the moonpool a subsea BOP (Blow Out Preventer) storage room, e.g. on a lower deck of the deckbox structure, e.g. the lowermost deck of the deckbox structure, is provided, wherein a set of BOP handling cart rails is provided, e.g. skid rails, extending from the subsea BOP (Blow Out Preventer) storage room towards and along opposed sides of the moonpool, and wherein vessel is provided with a BOP handling cart that travels over said BOP handling cart rails so as to allow for transfer of a subsea BOP (Blow Out Preventer) between the BOP storage room and a position aligned with the firing line.

The vessel of the third aspect of the invention may further include one or more of the technical features discussed herein with reference to the first aspect of the invention.

The third aspect of the invention also relates to a method of performing a subsea wellbore related operation, e.g. a drilling and/or wellbore intervention operation and/or installation of wellbore related subsea equipment, wherein use is made of a vessel as described with reference to the third aspect of the invention.

The third aspect of the present invention also relates to a method for assembly of a riser from a vessel according to the third aspect of the invention, which method comprises moving the air can from an air can storage room to a position aligned with the firing line through the moonpool, wherein the air can sticks out above the upper deck when stored, wherein the method comprising lifting a mobile working in order to allow for travel of the air can, e.g. on the respective air can handling cart, towards the moonpool and underneath the working deck into a position aligned with the firing line.

A fourth aspect relates to a semi-submersible drilling vessel, said vessel comprising:

- a deckbox structure having an upper deck and a box bottom;
- one or more pontoons, e.g. two parallel pontoons or a ring pontoon,
- multiple support columns extending upward from the one or more pontoons and supporting thereon the deckbox structure;
- an annular riser joints storage caisson extending downwardly from the deckbox structure, spaced from each of said support columns, wherein the storage caisson has an inner wall, an outer wall, and a storage caisson bottom, and wherein the storage caisson delimits an annular storage space configured for storage therein of an annular array of riser joints in vertical orientation thereof, wherein the vessel comprises a drilling installation with a drilling tower that is erected above the upper deck of the deckbox structure, which drilling installation is adapted to perform drilling operations along at least one firing line through a moonpool of the vessel.

In the fourth aspect of the invention a riser joints carousel device is provided in the annular storage space, which riser joints carousel device is configured to carry said annular array of riser joints in vertical orientation thereof in a mobile manner relative to the annular riser joints storage caisson so that said array of riser joints is movable along an annular path through the storage spaced between the inner and outer walls of the storage caisson.

In an embodiment of the fourth aspect of the invention the moonpool does not extend through the storage caisson, e.g.

is arranged offset of the storage caisson, e.g. in the deckbox structure at a position outward of the storage caisson.

In an embodiment of the fourth aspect of the invention the annular storage space of the storage caisson extends up till the upper deck of the deckbox structure, e.g. as in WO85/03050. As mentioned herein such embodiment does not offer the potential benefits of arranging one or more task oriented rooms, e.g. BOP storage, riser tensioning equipment, coil device, within the deckbox structure and above the annular storage room. Yet the provision of the carousel device does allow for a limited number of transfer locations, e.g. just one, where riser joints are transferred into and out of the storage carousel device.

The vessel of the fourth aspect of the invention may further include one or more of the technical features discussed herein with reference to the first aspect of the invention.

The fourth aspect of the invention also relates to a method of performing a subsea wellbore related operation, e.g. a drilling and/or wellbore intervention operation and/or installation of wellbore related subsea equipment, wherein use is made of a vessel as described with reference to the fourth aspect of the invention.

Figure 1B:
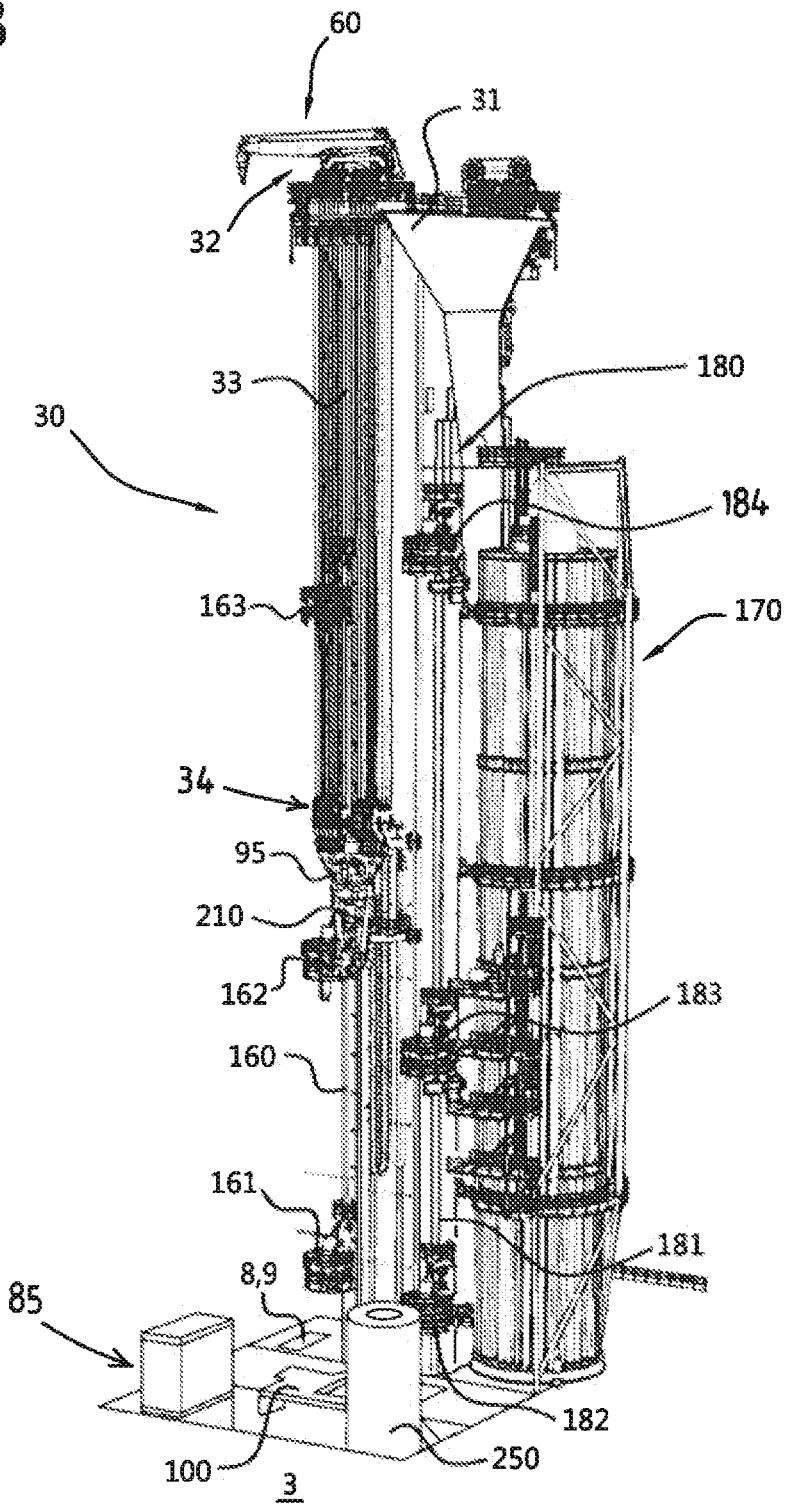
Figure 2:
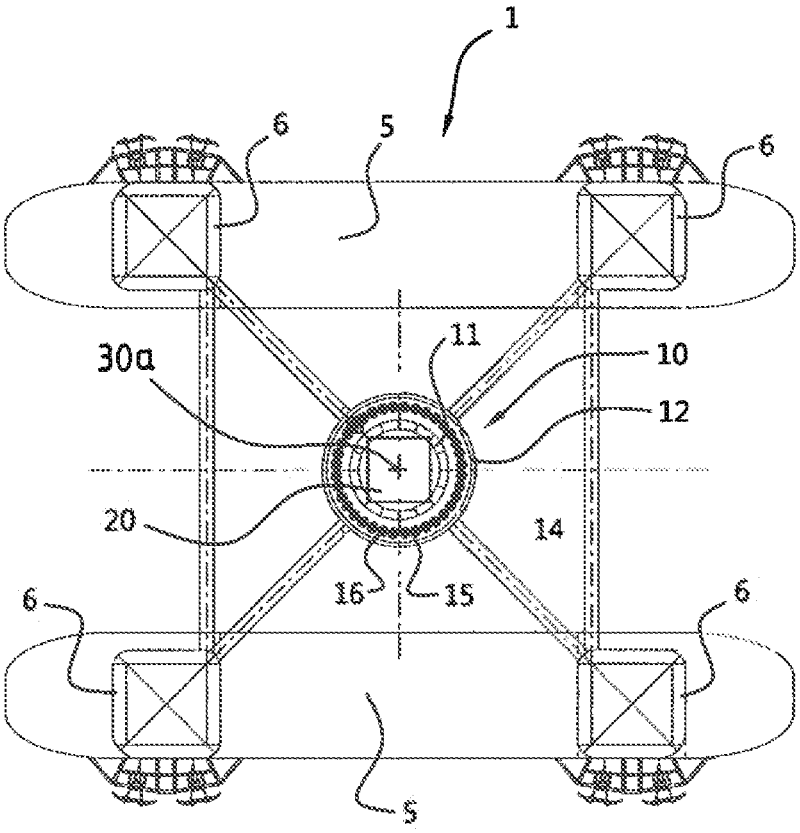
Figure 3A:
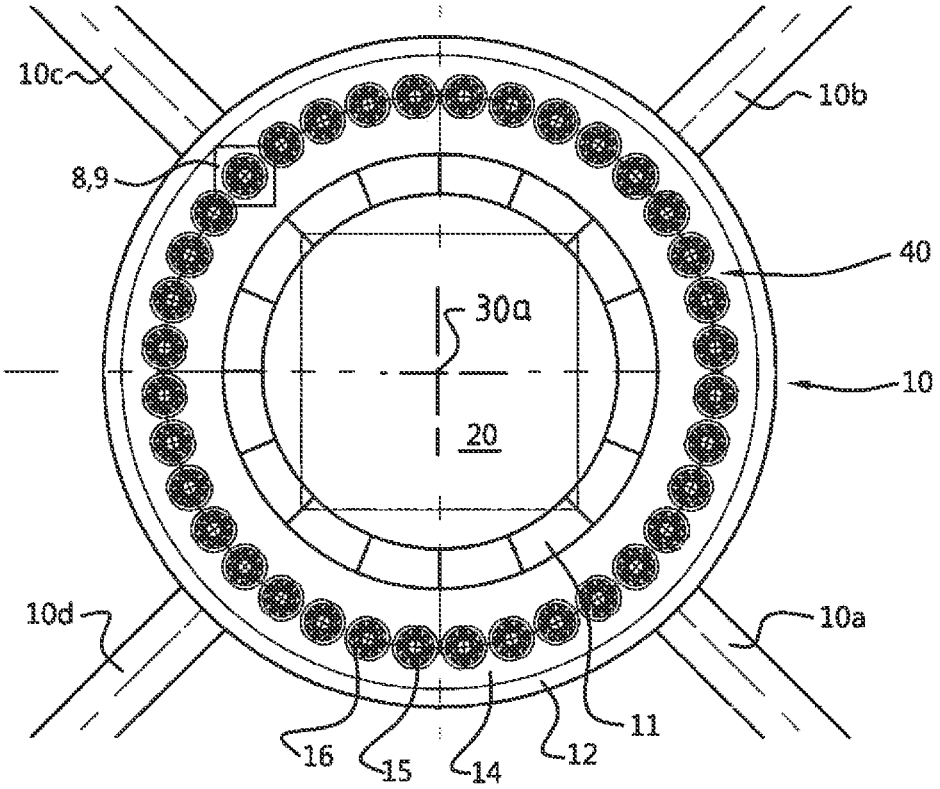
Figure 3B:
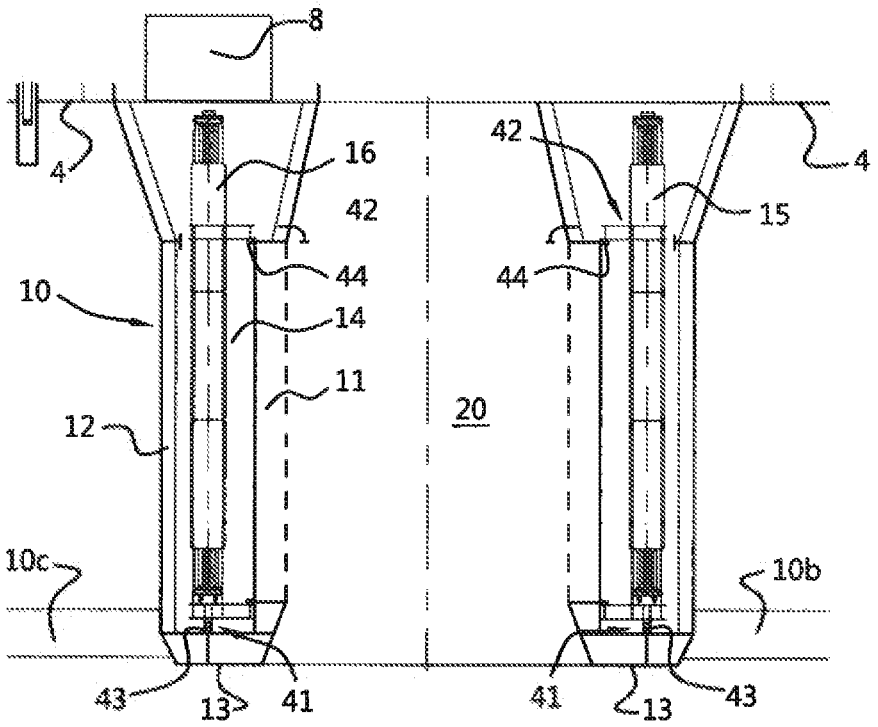
Figure 4:
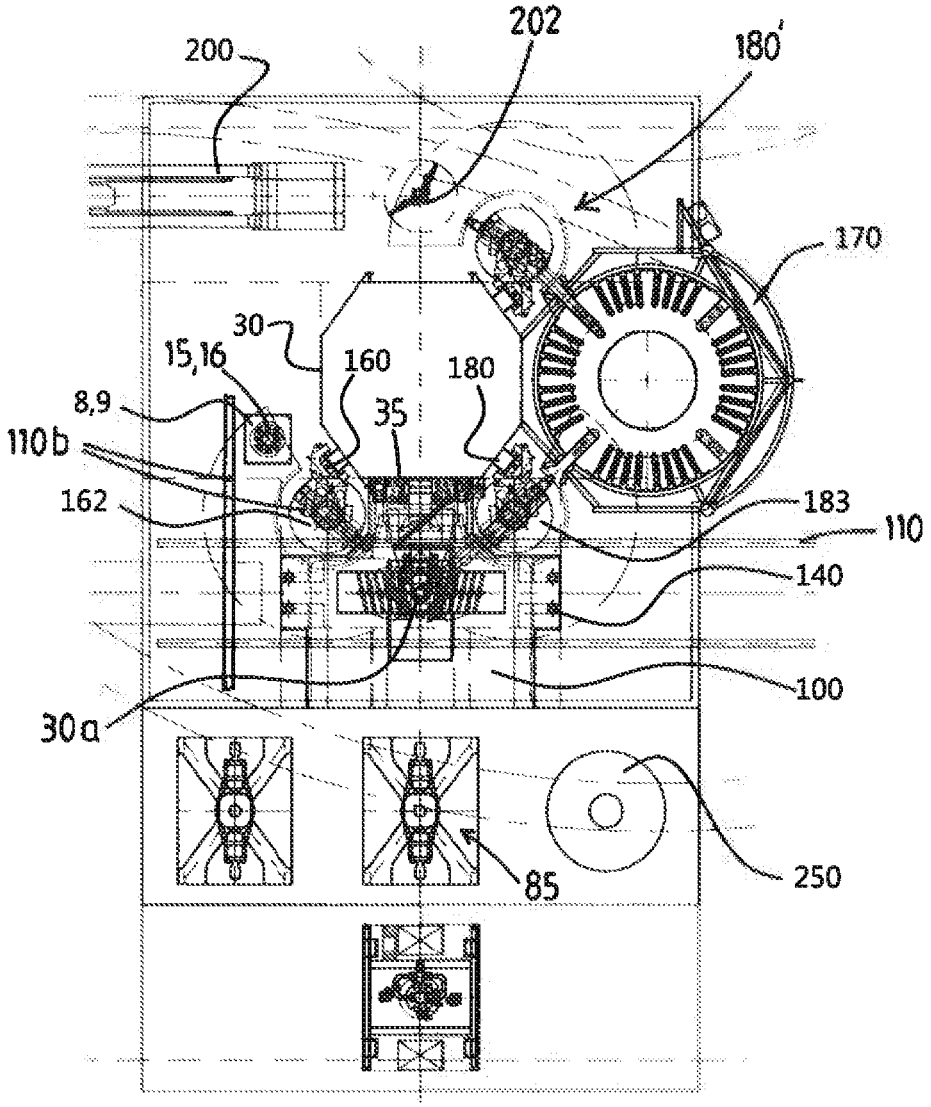
Figure 5:
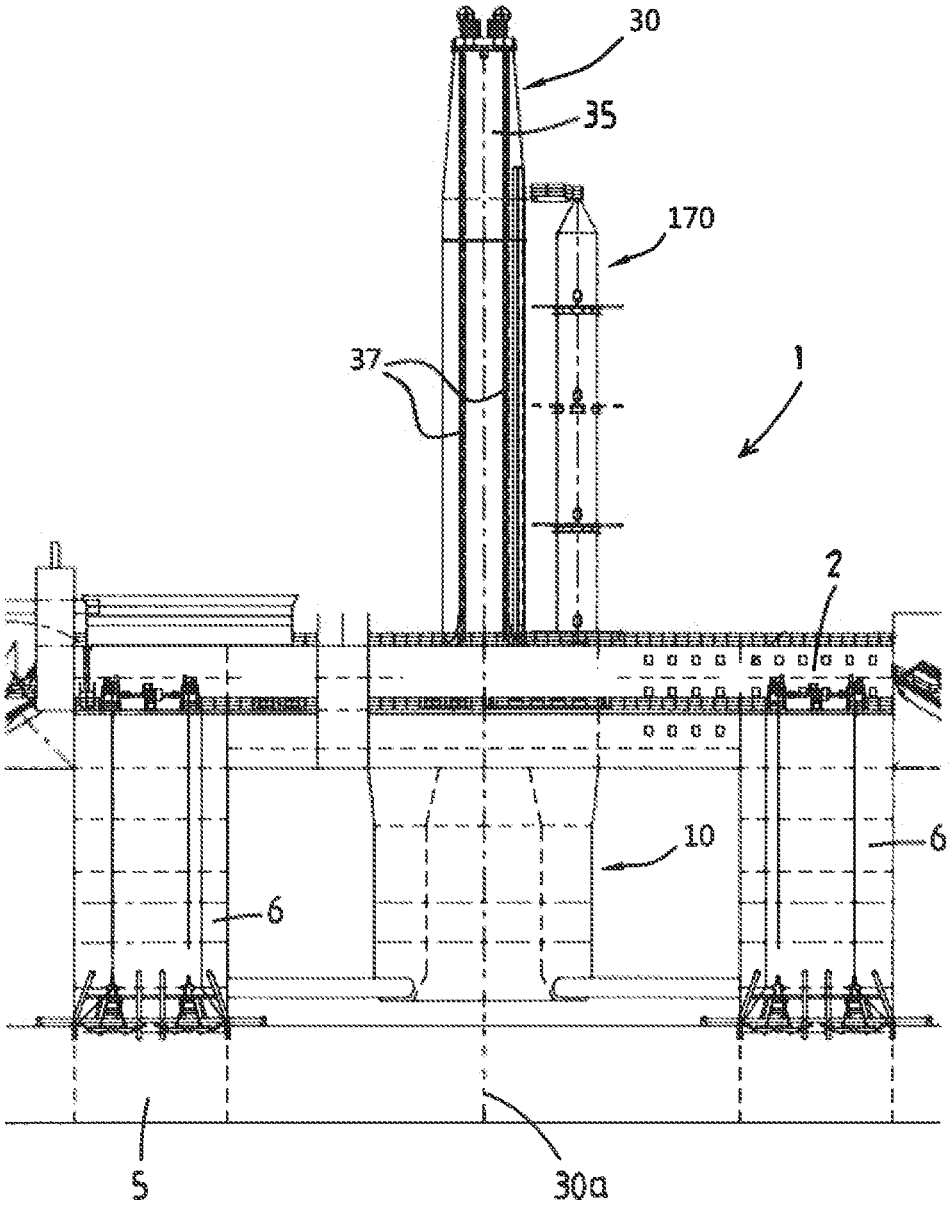
Figure 6:
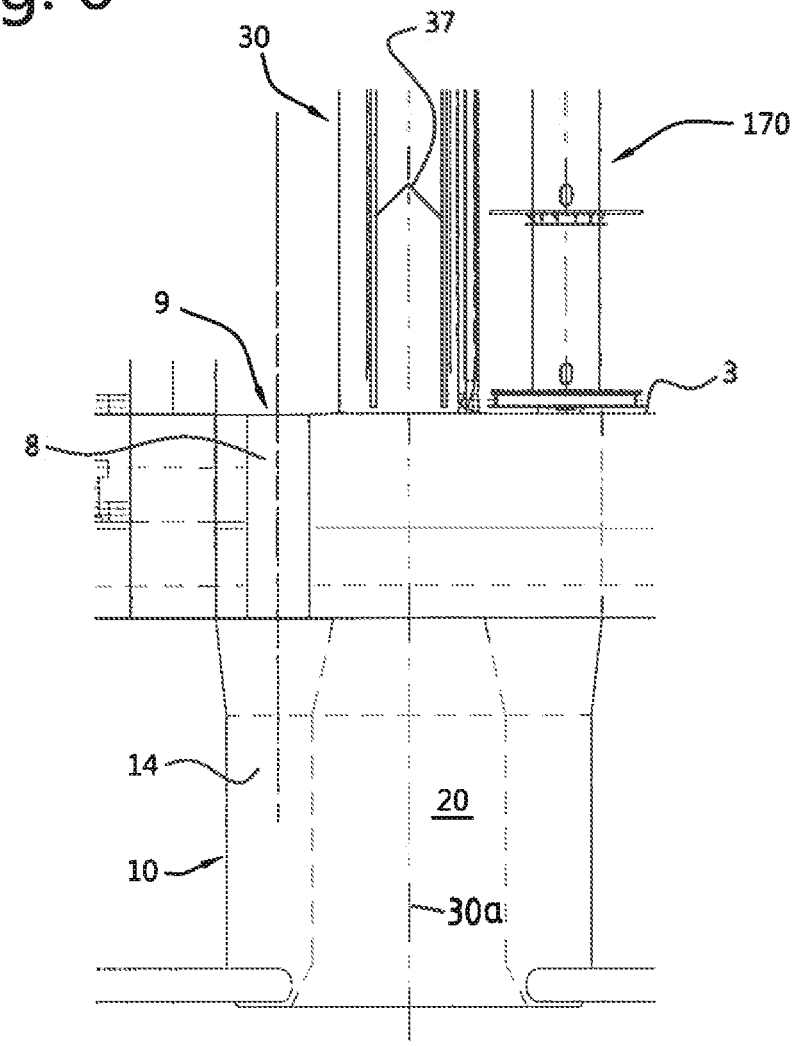
Figure 7:
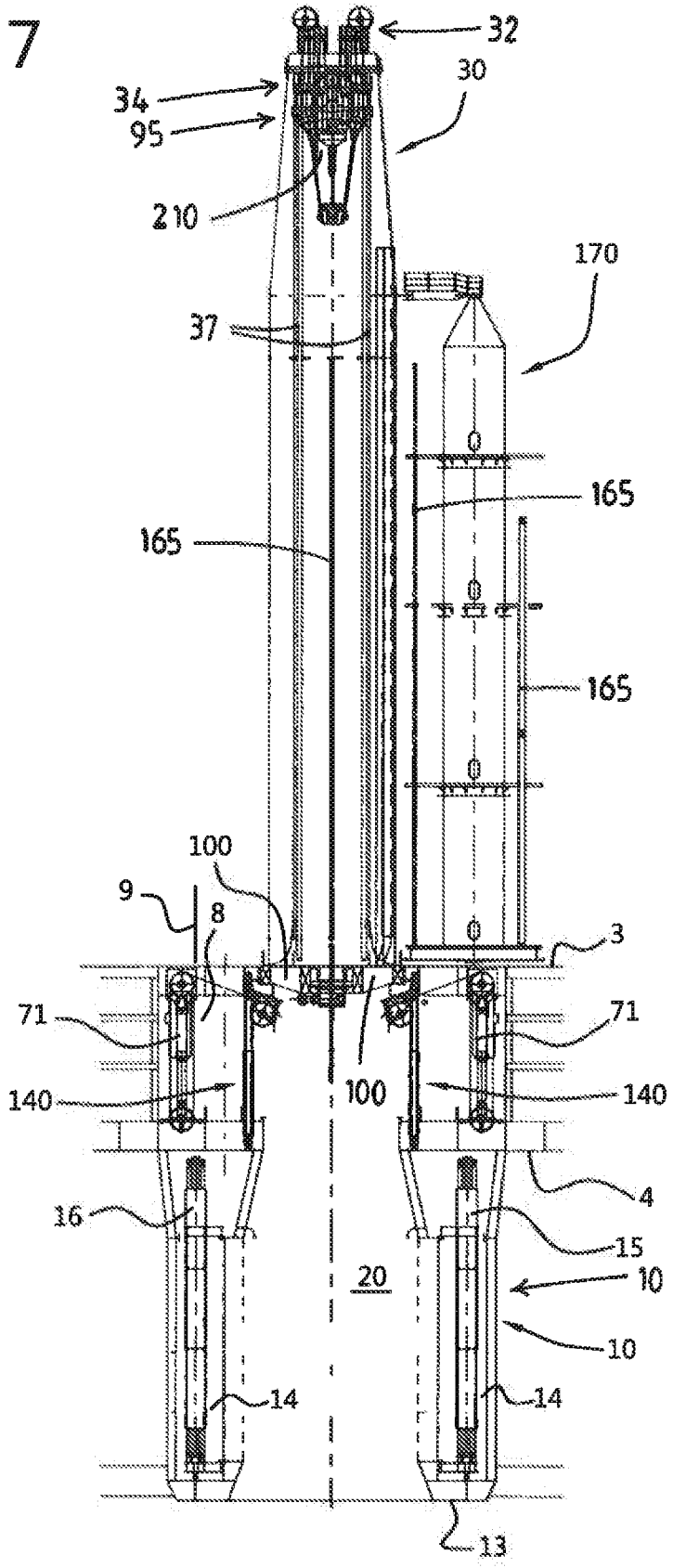
Figure 8A:
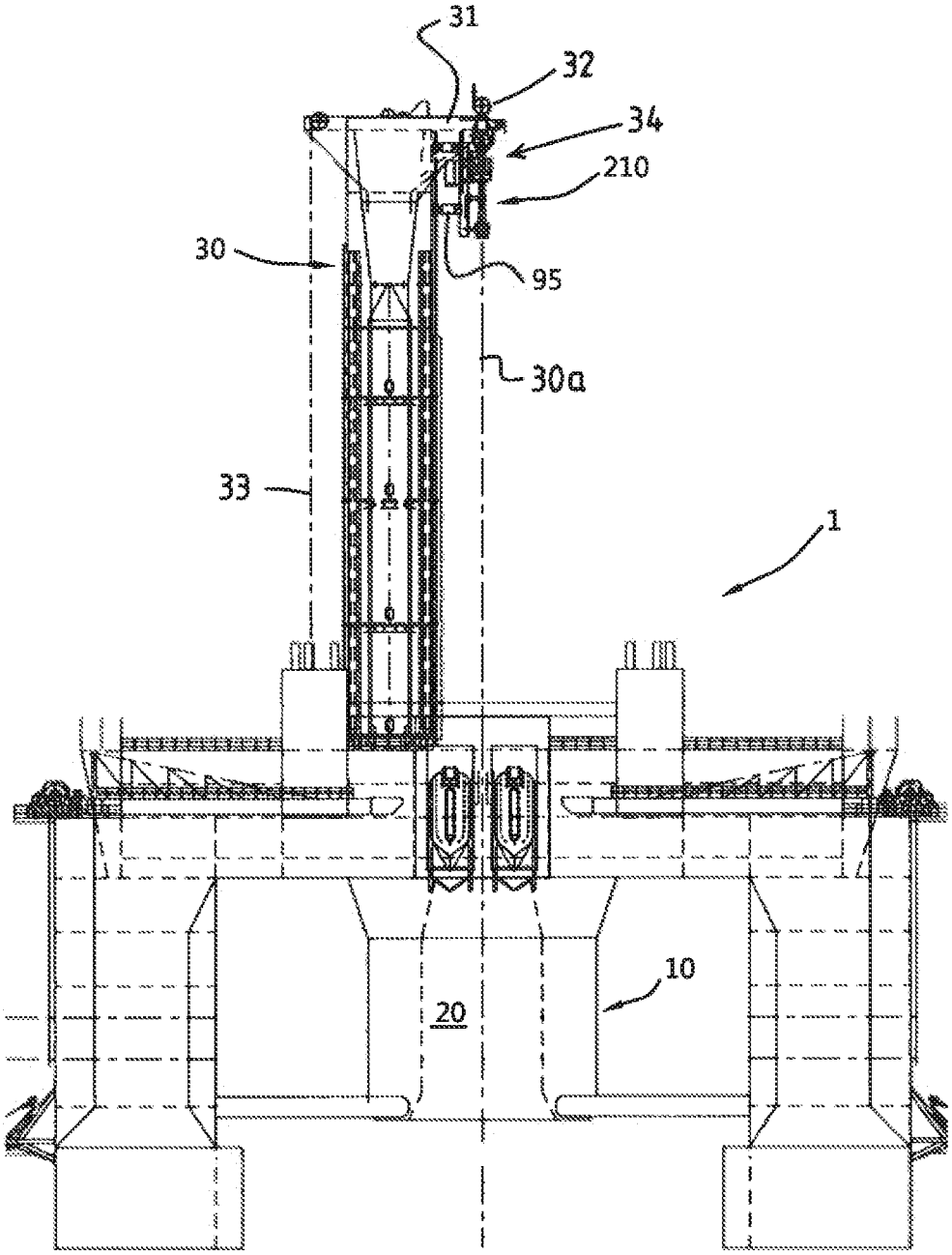
Figure 8B:
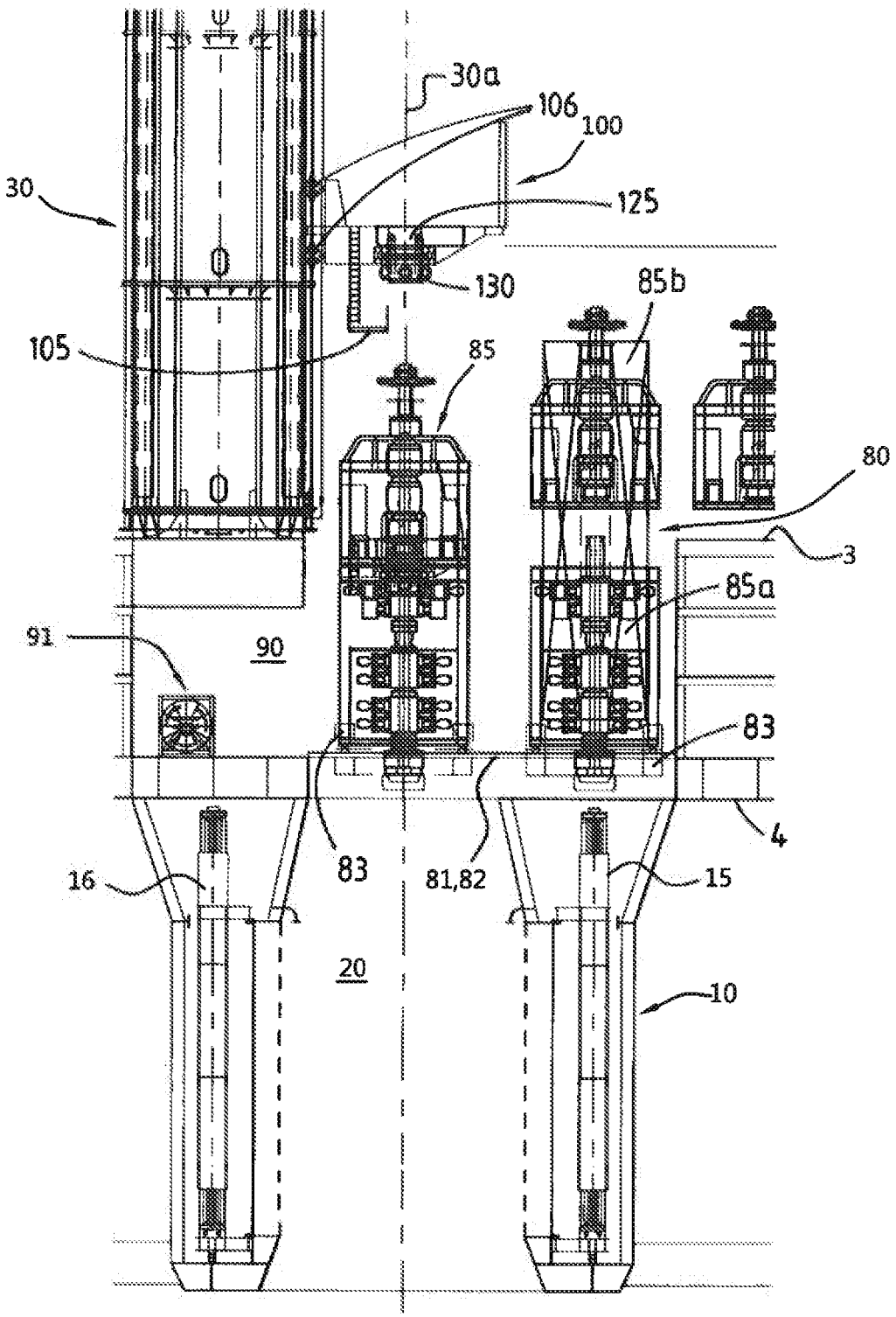
Figure 9A:
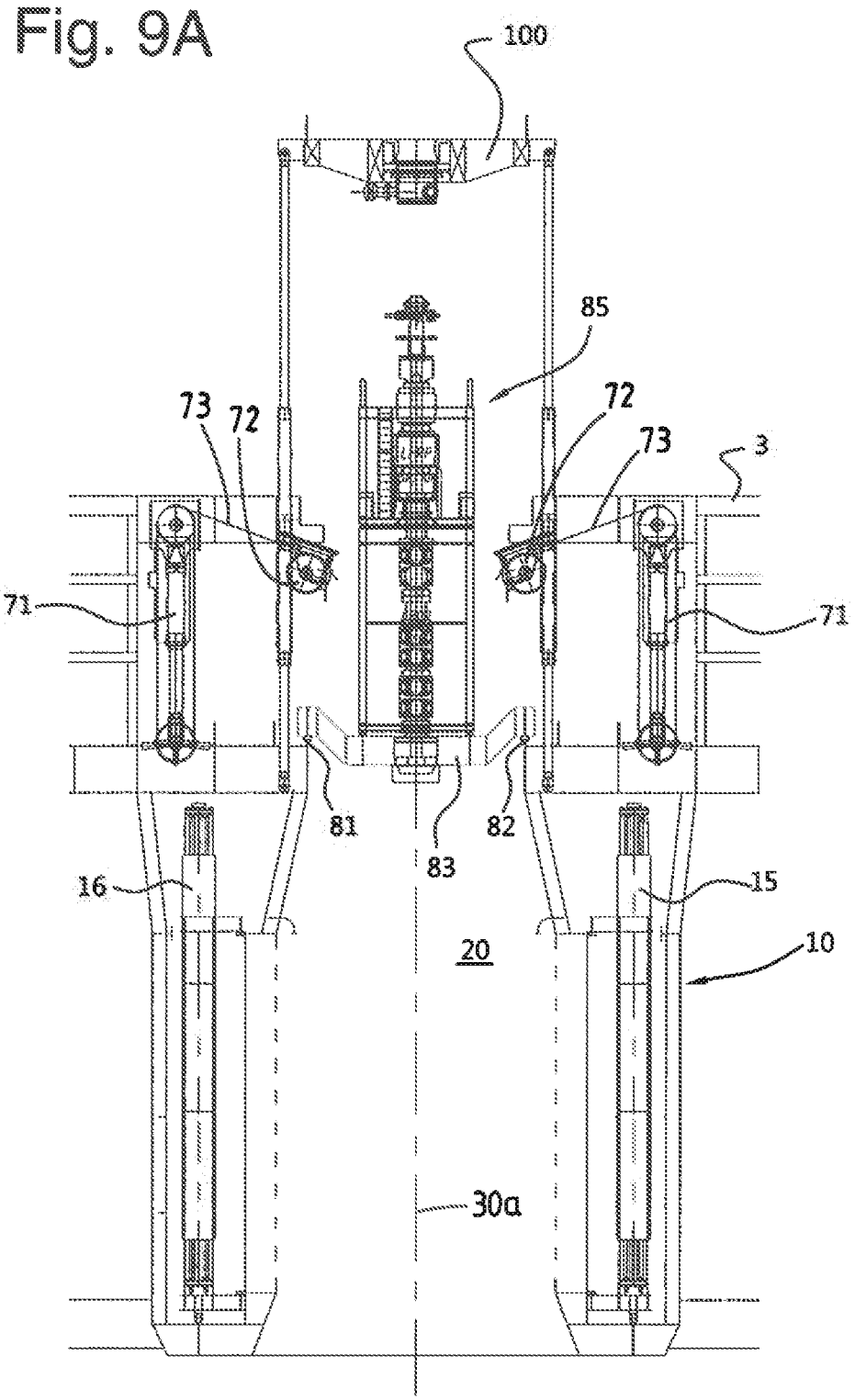
Figure 9B:
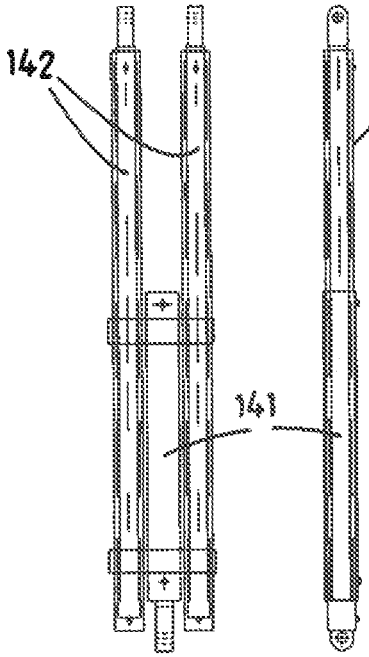
Figure 11:
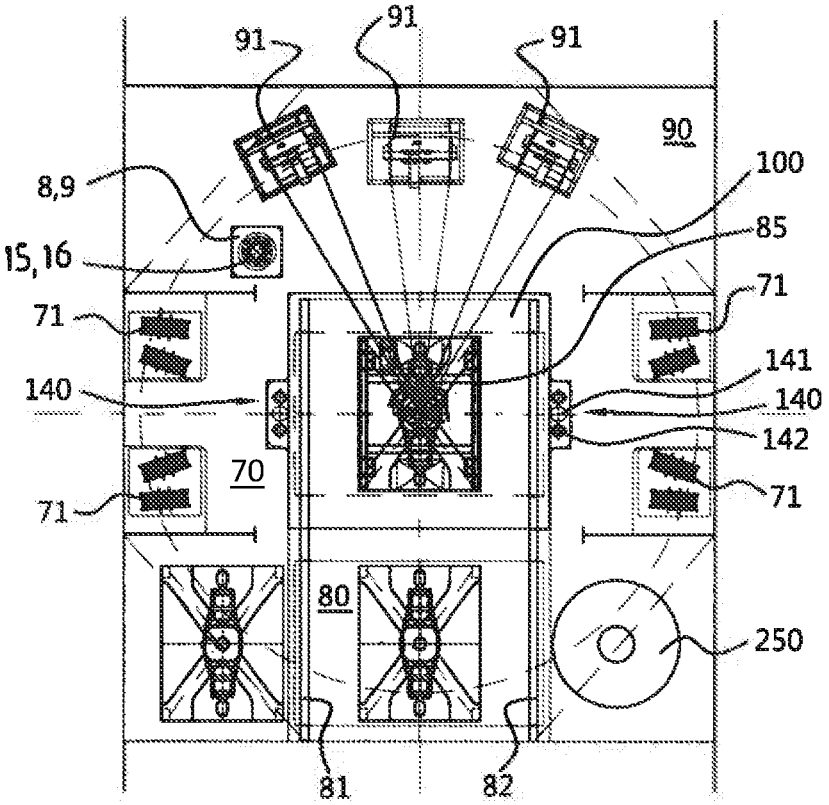
Figure 12:
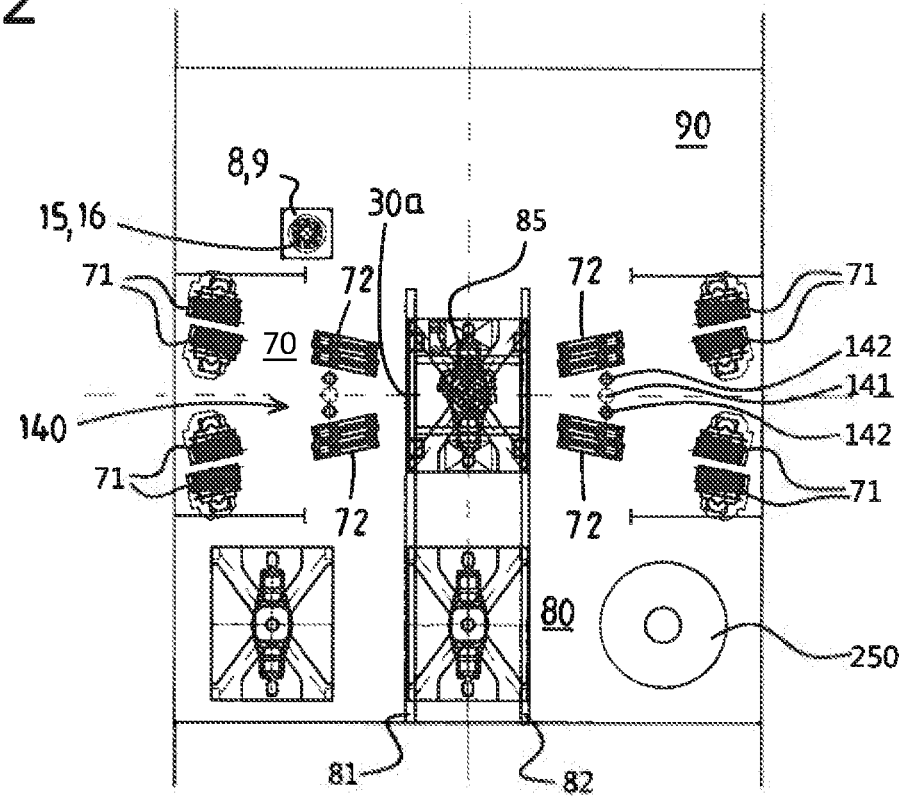
Figure 13:
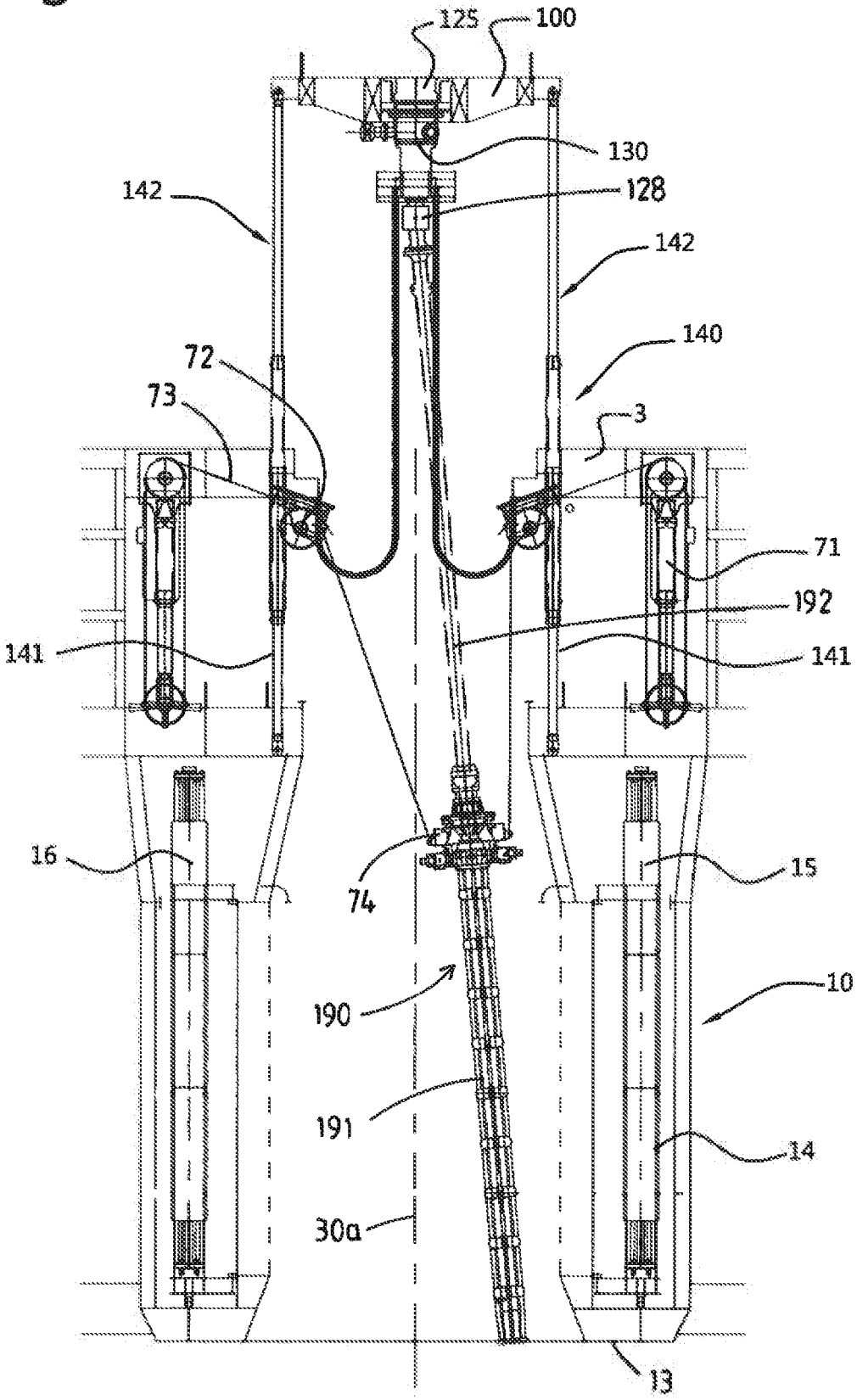
Figure 14C:
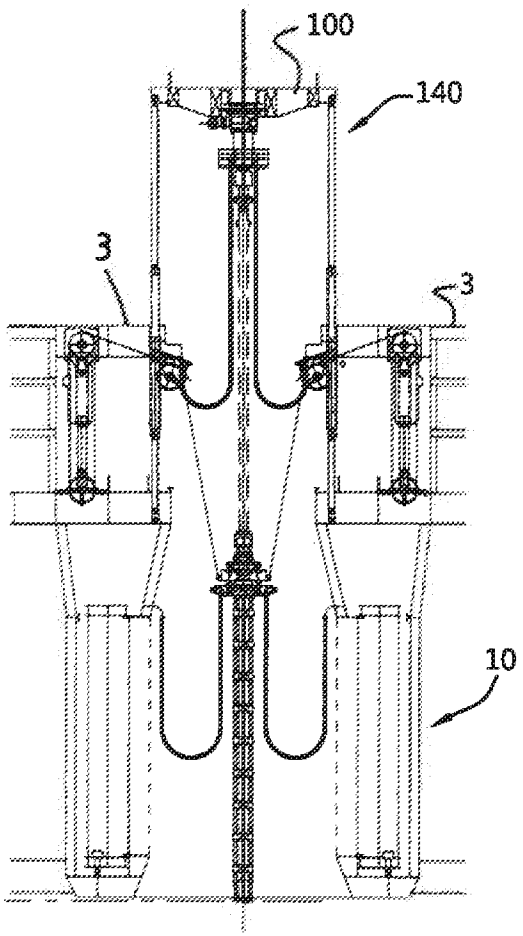
Figure 14B:
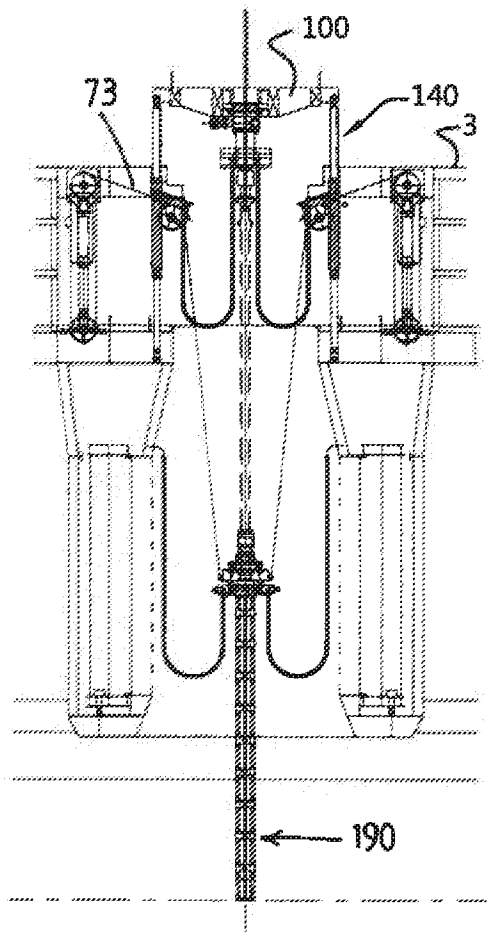
Figure 14A:
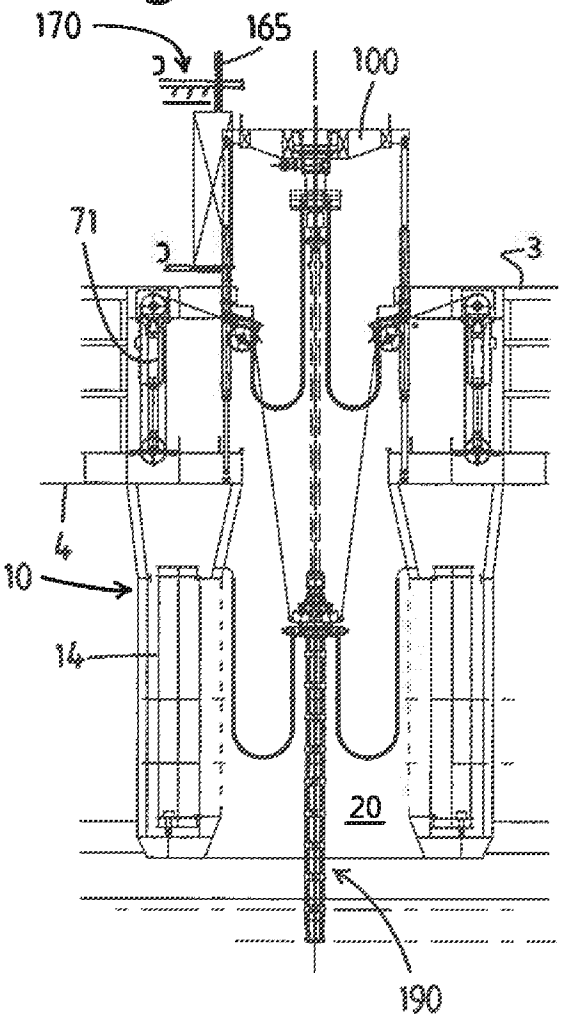
Figure 15C:
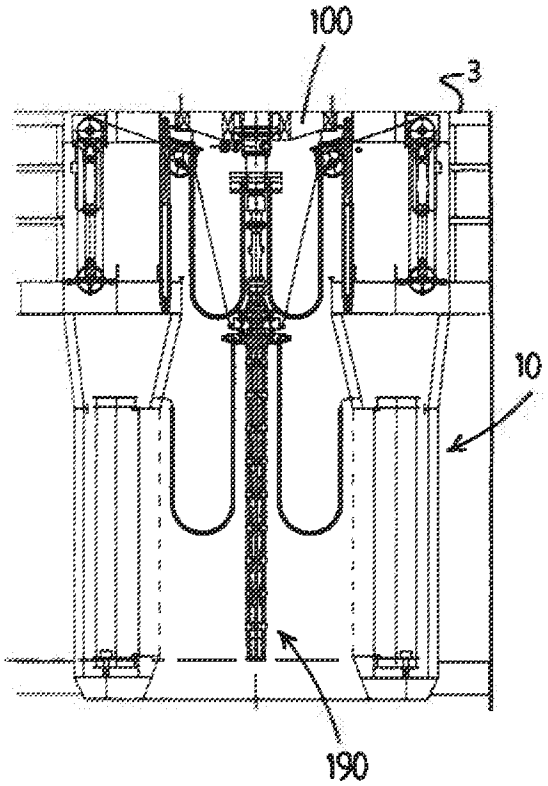
Figure 15B:
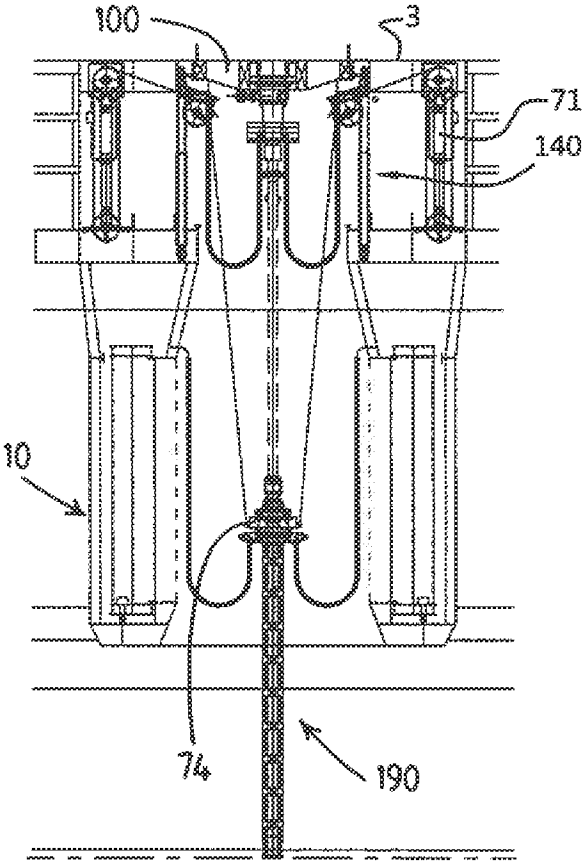
Figure 15A:
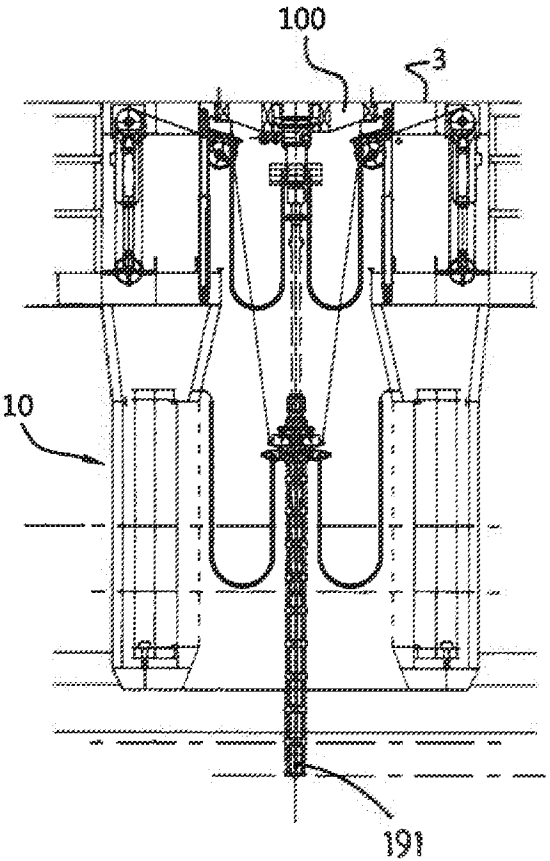

The invention will now be discussed with reference to the appended drawings. In the drawings:

FIG. 1A shows in perspective view an example of a semi-submersible drilling vessel according to the invention, FIG. 1B shows the drilling installation and the area of the moonpool of the vessel of FIG. 1, FIG. 2 shows a horizontal cross sectional view of the vessel of FIG. 1A, FIG. 3A shows an enlarged detail of the view of FIG. 2, FIG. 3B shows in vertical cross-section schematically the riser storage caisson and carousel device retaining riser joints of the vessel of FIG. 1, FIG. 4 shows a plan view of the vessel of FIG. 1 near the moonpool, FIG. 5 shows a side view of the vessel of FIG. 1, FIG. 6 shows an enlarged detail of the view of FIG. 5, FIG. 7 shows a vertical cross section of the vessel through the firing line, in a direction in according with the view of FIG. 5, FIG. 8A shows a rear view of the vessel of FIG. 1, FIG. 8B shows a vertical cross-section of the vessel of FIG. 1 in the direction of the rear view of FIG. 8A at the firing line, FIG. 9A shows a vertical cross section of a part of the vessel of FIG. 1 in the direction of the BOP cart rails, FIG. 9B, C illustrate a combination of a lift cylinder and heave compensation cylinders supporting the mobile working deck of the vessel of FIG. 1 in fully retracted state and in fully extended state, FIGS. 10*a, b, c* illustrate the handling of a BOP with the vessel of FIG. 1, FIG. 11 illustrates the layout of the rooms adjacent the moonpool, as well as the BOP cart rails and an outline of the mobile working deck and respective compensator cylinders, FIG. 12 illustrates the arrangement of the riser tensioner cylinders relative to the working deck compensator cylinders, and the location of the wireline sheaves of the riser tensioner system, FIG. 13 illustrates the working deck in heave motion compensation mode on the working deck compensator cylinders, with a riser including extended telescopic riser joint, flex joint, and diverter below the working deck, as well as the wireline riser tensioner system in operation, FIGS. 14*a, b*, and *c* illustrate the working deck in elevated position with the lift cylinders extended and with the heave compensation cylinders in center position, the working deck in an extreme heave compensated position, and the working deck in the other extreme heave compensated position, FIGS. 15*a, b, c* illustrate the working deck in stationary resting position, flush with the adjoining upper deck area, with a riser and telescopic riser joint in the center position, one extreme heave motion position, and another extreme heave motion position.

The invention will now be elucidated with reference to an exemplary harsh environment semi-submersible drilling vessel 1 shown in the drawings.

The vessel 1 comprises:

- a deckbox structure 2 having an upper deck 3 and a box bottom 4,
- one or more pontoons 5, here two parallel pontoons,
- multiple, here four, support columns 6 extending upward from the one or more pontoons 5 and supporting thereon the deckbox structure 3,
- an annular riser joints storage caisson 10 extending downwardly from the deckbox structure 3, spaced from each of said support columns 6.

The storage caisson 10 has an inner wall 11, an outer wall 12, and a storage caisson bottom 13. The inner and outer walls are preferably each of double walled design. Preferably the inner wall is embodied as a wave breaking cofferdam as is known for moonpools in the splash zone of drilling vessels.

The storage caisson 10 delimits an annular storage space 14 configured for storage therein of an annular array of riser joints, here 15, 16, in vertical orientation thereof.

As is known in the art a riser joint may comprise a main pipe as well as auxiliary pipes alongside the main pipe, e.g. choke and kill pipes and/or other auxiliary pipes. Commonly the riser joint is provided with buoyancy modules to reduce the weight in water.

The inner wall 11 of the storage caisson 10 forms a lower section of a moonpool 20 of the vessel 1. An upper section of the moonpool extends through the deckbox structure 2 up to the upper deck 3 of the deckbox structure.

For example the height of the deckbox structure between the upper deck 3 and the box bottom is between 11 and 15 meters, e.g. about 12.5 meters.

The vessel comprises a drilling installation with a drilling tower 30 erected above the upper deck 3 of the deckbox structure 2 and adapted to perform drilling operations along at least one firing line 30*a* of the drilling installation that vertically extends through the moonpool 20 into the sea.

A riser joints carousel device 40 is provided in the annular storage space 14 of the caisson.

The riser joints carousel device 40 is configured to carry the annular array of riser joints 15, 16 in vertical orientation thereof in a mobile manner relative to the annular storage caisson 10 so that said array of riser joints is movable along an annular path through the storage space between the inner wall 11 and the outer wall 12 of the storage caisson 10.

The deckbox structure is provided with a riser joint transfer passage 8 at a riser joint transfer location 9 above the annular path of the riser joints 15, 16 carried by the riser joints carousel device 40 through the storage space 14.

The vessel is provided with a riser joint vertical transfer device, e.g. a crane 60 or 65, that is configured to lift and lower a riser joint 15, 16 out of and into the riser joints carousel device 40, passing therein vertically through the riser joint transfer passage 8 of the deckbox structure 2.

By provision of the riser joints carousel device 40 it is possible to align a selected riser joint 15, 16 stored therein with the riser joint transfer passage 8 at the riser joint transfer location 9 and then lift the selected riser joint 15, 16 out of the carousel device 40. For example, as here, just one such riser joint transfer passage 8 at just one riser joint transfer location 9 is provided on the vessel 1.

The storage space 14 for the riser joints 15, 16 is are arranged with its upper end, e.g. formed in part by a roof over the storage space 14, at a distance below the upper deck 3 of the deckbox structure, here as most preferred below the box bottom 4 of the deckbox structure 3. So, contrary to the disclosure of WO 85/03050, it is envisaged that the riser joints storage space 14 does not extend through the deckbox structure 2 up till the upper deck 3. Instead the top of the storage space 14 is at a height below the upper deck 3 and a riser joint transfer passage 8 extends from the top of the storage space 14 through, at least a part of, the height of the deckbox structure 2 to the upper deck 3.

As is preferred the cross-sectional dimensions of the transfer passage 8 is attuned to the maximum diameter of the riser joints 15, 16 that can be stored in the carousel device 40.

The transfer passage 8 may comprises a vertical duct structure, e.g. over at least part of the height to be traveled by a riser joint 15, 16 between the top of the storage space 14 and the upper deck 3. The passage 8 may, however, also be embodied by mere vertically aligned openings in various decks of the deckbox structure, with unrestricted vertical space between such deck openings.

As shown here the riser joints storage caisson 10 is substantially cylindrical with a circular cross-section of the inner and outer walls 11, 12 defining the storage space 14 between them.

The bottom 13 of the storage caisson 10 is, as preferred located above the transit waterline of the vessel, herein the top sides of the pontoons being above that transit waterline, so that the caisson 10 does not drag through the water during transit. In operational situation the semi-submersible is ballasted to an operational waterline, as is common, so that the storage caisson 10 is partially submerged in the water and provides a buoyant force. Also, in such operational situation, the moonpool 20 is then effectively shielded by the surrounding caisson 10 with mainly vertical wave motion within the moonpool 20.

The vessel 1 as shown and preferred has four supporting columns 6 in a rectangular or square arrangement. The caisson 10 is located in the center between the columns 6, here with a diagonal brace 10*a, b, c, d* between the caisson 10 and each of the columns 6.

As often seen further bracing is provided, above transit waterline, between the pairs of columns 6 that each stand on a respective pontoon 5.

The riser joints carousel device 40 comprises a series of riser joint carriers. Here a series of lower riser joint carriers 41 is provided that is configured to support one or more riser joints 15, 16 at a lower end thereof. Furthermore a series of upper riser joint carriers 42 is here provided, which carriers 42 are configured to support one or more riser joints 15, 16 at an elevated position, e.g. at or near the top end of the riser joint. The weight of the riser joints 15, 16 is effectively supported, at least in majority, by the series of lower carriers 41. The upper carriers 42 predominantly serve to keep the riser joints 15, 16 in upright position.

In operation of the carousel device 40 the lower and upper series of carriers 41, 42 move in unison so that the riser joints 15, 16 remain in vertical orientation.

It will be appreciated that instead of a series of carriers one could also provide one unitary annular carrier structure that supports and/or retains the riser joints.

Preferably each carrier 41, 42 runs over a rail track with one or more rails 43, 44. For example a lower carrier 41 resembles a railway dolly that is configured to support one riser joint thereon.

Here each carrier 41, 42 is adapted to carry just one riser joint 15, 16 in vertical orientation thereof. So for example a wheeled carrier is arranged on or near the bottom of the storage space 14 of the caisson 10, and is configured to support one riser joint 15, 16 thereon in vertical orientation.

In an embodiment the riser joint carriers 41, 42 are linked to form a series, e.g. by hinges and/or chains and/or cables, etc. to form an annular unit. For example a drive is provided for such an annular unit of riser joint carriers 41, 42. In another embodiment individual riser joint carriers 41, 42 or groups of multiple riser joint carriers are provided with a respective drive to move the riser joint carriers through the annular storage caisson along the annular path between the inner and outer wall. For example a drive for the carousel device comprises a rack-and-pinion drive mechanism, or a chain drive mechanism, a skidding mechanism (e.g. in combination with carriers embodied as skiddable carriers that move over associated skid rails of the carousel device).

Here, as preferred a single annular array of riser joints is stored in the caisson, e.g. the riser joints having a combined length of at least 500 meters, e.g. between 500 and 1000 meters, e.g. each riser joint having a length between 50 ft. and 90 ft., e.g. of 65 ft. or 75 ft.

For example between 15 and 50 riser joints are storable or stored in the caisson 10.

In the depicted example, wherein all major structural components of the vessel 1 are to scale, the caisson 10 and associated carousel device 40 are configured to store therein 36 riser joints of 65 ft. length each, totaling 2340 ft., which is about 710 meter. This is considered sufficient for most areas where the vessel 1 will be operational. In case the water depth is greater it may well be possible to store additional riser joints elsewhere on the vessel 1, e.g. horizontally on the upper deck 3 of the vessel 1.

As is preferred, e.g. in view of a slender design of the caisson 10, the carousel device 40 is configured to store a single annular array of riser joints 15, 16, most preferably all riser joints on the same circle (e.g. in view of engagement of the riser joints 15, 16 at the location 9 by a handling device).

In an alternative design riser joints could be stored alternatingly offset inwards and outwards relative to a common circle, e.g. in view of arrange more riser joints in the caisson.

In yet another design an inner carousel device and an outer carousel device are provided in the storage caisson 10, each carousel device being configured to store therein a respective array of riser joints in vertical orientation, e.g. the inner and outer carousel device being operable, movable, independently from one another. This may, if desired be done in combination with two riser transfer passages, or with one larger transfer passage above both the inner and the outer carousel device.

The deckbox structure 2 comprises, in vertical projection above the annular storage space 14 of the storage caisson 10 and adjoining the moonpool 20, one or more wireline riser tensioner equipment rooms 70 accommodating therein wireline riser tensioner equipment, e.g. comprising vertically oriented wireline riser tensioner cylinders 71. This equipment is configured to provide top tension to a riser that has been assembled from the riser joints 15, 16 taken from the riser storage caisson 10 of the vessel.

As preferred these rooms 70 are below the upper deck 3 and are located adjoining the moonpool 20, e.g. said area of the upper deck being flush with a mobile working deck 100 in its lower resting position, which deck 100 is arranged above the moonpool 20 as will be explained herein. So the invention provides for the option to have the wireline riser tensioner equipment 71 close to the moonpool 20, effectively above the storage space 14 for the riser joints 15, 16 in the caisson 10, with the riser joint transfer passage 8 not interfering with the riser tensioner equipment 71. It will be appreciate that, in an embodiment, the vessel 1 may also, or as an alternative to wireline riser tensioner system, be equipped with a riser tensioner system with direct acting riser tensioner cylinders as is known in the art.

The deckbox structure 2 comprises, in vertical projection above the annular storage space 14 of the storage caisson 10 and at a location that adjoins the moonpool 20, a subsea BOP (Blow Out Preventer) storage room 80, e.g. on a lower deck of the deckbox structure, here on the lowermost deck of the deckbox structure as preferred.

A set of BOP handling cart rails 81, 82 is provided, e.g. skid rails, extending from the subsea BOP (Blow Out Preventer) storage room 80 towards and along opposed sides of the moonpool 20.

The vessel is provided with a BOP handling cart 83 travelling over said BOP handling cart rails 81, 82 so as to allow for transfer of a subsea BOP 85 (Blow Out Preventer) between the BOP storage room 80 and a position aligned with the firing line 30*a*. The BOP 85 may be, as often seen in practice, a tall BOP with an upper portion thereof sticking out above the upper deck 3 of the deckbox 2. This is for example envisaged in combination with a vertically mobile working deck 100 over the moonpool 20, that in an elevated position thereof allows for bringing the tall BOP 85 underneath the elevated working deck 100 in alignment with the firing line 30*a*.

The BOP storage room 80 is in open communication with the moonpool 20 and through one or more vent openings in any of the roof and/or sidewalls of the room (when present), or through the room 80 being fully open (as here) at the level of the deck 3 as here, with the exterior e.g. above the upper deck, so as to allow for continuous venting of the moonpool, e.g. in view of an air piston effect caused by the wave action of the water within the lower section of the moonpool 20 formed by the caisson 10. Due to the continuous venting via the BOP storage room 80, and/or via an alternative route through the deckbox structure, an undesired built-up of air pressure and resulting air motion is prevented effectively.

The deckbox structure 2 comprises, in vertical projection above the annular storage space of the storage caisson 10 and adjoining the moonpool 20, a spoolable product coil devices room 90 accommodating therein one or more coil devices 91, each having a coil storing thereon a spoolable product, such as a (control) line, wireline, cable, hose, coiled-tubing, umbilical, etc. Preferably this room 90 is open towards the moonpool 20, allowing to pass the one or more spoolable products from the respective coil device 91 towards the firing line 1, e.g. an umbilical that is to be attached to the exterior of the riser.

The vessel 1 is provided with a mobile working deck 100 which is arranged in vertical projection above the moonpool 20, which working deck 100 is vertically movable, e.g. by one or more hydraulic cylinders arranged between the working deck 100 and the deckbox structure 2 as will be explained herein in more detail.

The working deck 100 is in a lower stationary resting position thereof flush with at least an adjoining area of the upper deck 3 of the deckbox structure 2. Herein the working deck 100 and the adjoining area of the upper deck 3 of the deckbox structure are provided with rail tracks 110 configured to transfer equipment over said rail tracks, e.g. equipment being arranged on a skid pallet skiddable over said rail tracks 110, onto and off the working deck 100.

The working deck 100 is configured to be elevated, preferably by an arrangement of cylinders 140, 141, 142 between the deck 100 and the deckbox 2, relative to a stationary resting position thereof, the latter e.g. being flush with an adjoining area of the upper deck 3, and to be movable within a motion range including a heave compensation motion range. As preferred the heave compensation motion range of the working deck 100 is above the elevated position of the same working deck.

For example the height of the elevated working deck 100 above the upper deck 3 is between 4 and 6 meters, e.g. 5 meters.

For example the heave compensation motion range has a height of between 7 and 12 meters, e.g. of approximately 10 meters.

For example the maximum height of the working deck 100 above the upper deck 3 is between 10 and 18 meters, e.g. approximately 15 meters.

The working deck 100 may be provided with a personnel access platform 105 supported underneath the working deck 100 that facilitates access to equipment underneath the working deck 100 during operations, e.g. drilling operations.

At least one of a drill string slip device 125, a riser spider device, and/or a diverter 130 is supported by the mobile working deck 100. For example a diverter 130 is arranged on the underside of the working deck 100.

The drill string slip device 125, e.g. having mobile clamping jaws, is configured to support a suspended drill string within a riser.

The riser spider device is configured to support a suspended riser, e.g. during assembly and disassembly of a riser. For example the riser spider device has radially movable dogs that engage underneath a flange of a riser joint to support the weight of the riser string.

The diverter 130 is configured to divert a hydrocarbon and/or drilling mud stream from a subsea wellbore to the vessel. Commonly a hose or pipe connects the diverter 130 to a mud handling facility onboard the vessel 1, e.g. located within the deckbox structure 2.

As shown multiple vertically mounted working deck compensator cylinders 140 are arranged between the deckbox structure 2 and the mobile working deck 100, here two sets of multiple compensator cylinders, e.g. two pairs, supporting the mobile working deck. Preferably the working deck compensator cylinders 140 are configured to provide a heave compensated motion of the working deck 100 relative to the deckbox structure.

A first set of working deck compensator cylinders 140 is arranged outward of a first BOP handling cart rail 81, relative to the moonpool 20, and a second set of working deck compensator cylinders 140 is arranged outward of a second BOP handling cart rail 82, relative to the moonpool 20, so as to allow for passing a subsea BOP 85 on a BOP handling cart 83 in between the first and second set of working deck compensator cylinders 140.

For example the working deck compensator cylinders 140 are extendable to raise the mobile working deck 100 from its stationary resting position into an elevated position so as to allow for passage of the subsea BOP 85 from the BOP storage room 80 into the firing line 30*a* and underneath the working deck 100. As preferred working deck compensator cylinders 140 not only allow for raising and lowering of the working deck 100 but also for heave compensation motion of the working deck 100, e.g. with a riser connected via a telescopic joint 190 to the working deck 100.

As is common the telescopic joint 190 has a cylinder body or barrel 191 and a piston part 192 that is telescopic relative to the cylinder body 191. The body 191 here is suspended via riser tension ring 74 from wireline 73 of riser tensioning equipment of the vessel.

A first set of vertically oriented wireline riser tensioner cylinders 71 is arranged outward of a first set of working deck compensator cylinders 140, relative to the moonpool, and a second set of vertically oriented wireline riser tensioner cylinders 71 is arranged outward of a second set of working deck compensator cylinders 140, relative to the moonpool. This allows for a compact arrangement of the compensator cylinders 140 and the wireline riser tensioner cylinders 71, e.g. with sheaves 72 for the wirelines 73 to the riser tension ring 74 being arranged in proximity of the working deck compensator cylinders 140.

As is common a flex joint 128 may be provided in the riser string, above the telescopic joint 190, to allow for angular positions of the riser.

The multiple vertically mounted working deck compensator cylinders 140 are here secured at a lower end thereof to a lower deck of the deckbox structure, e.g. the lowermost deck of the deckbox structure in view of having maximum height for these cylinders.

In an embodiment, as shown here, the mobile working deck compensator 140 comprises in series:

- a lift cylinder 141 that is configured to lift the mobile working deck 100 out of the stationary resting position and to move the mobile working deck between the lowered position and an elevated position, e.g. over a height between 4 and 6 meters, e.g. approximately 5 meters, and
- a heave compensation cylinder 142 that is configured to provide a heave compensated motion of the mobile working deck 100 when lifted in the elevated position by the lift cylinder 141, allowing for motion of the mobile working deck 100 between a heave compensation maximum height position and a heave compensation minimum height position.

This arrangement of the combination of a lift cylinder and a heave compensation cylinder allows for a relatively reduced length of the heave compensation cylinder 142, or cylinders, as this cylinder(s) 142 only has to have a stroke length attuned to the expected maximum heave motion compensation. The lifting of the mobile working deck 100 to the elevated position by a dedicated lift cylinder 141 for example avoids any risk of the working deck reaching its stationary resting position during a heave motion operation wherein the lift cylinder 141 remains extended and the heave compensation cylinder 142 performs the heave motion, and for example allows for reliably passing of lines, pipes, etc. from underneath the working deck, e.g. from the diverter 130 and/or a rotary control device (RCD) to locations outside of the moonpool, e.g. onto the upper deck.

Figure 9C:
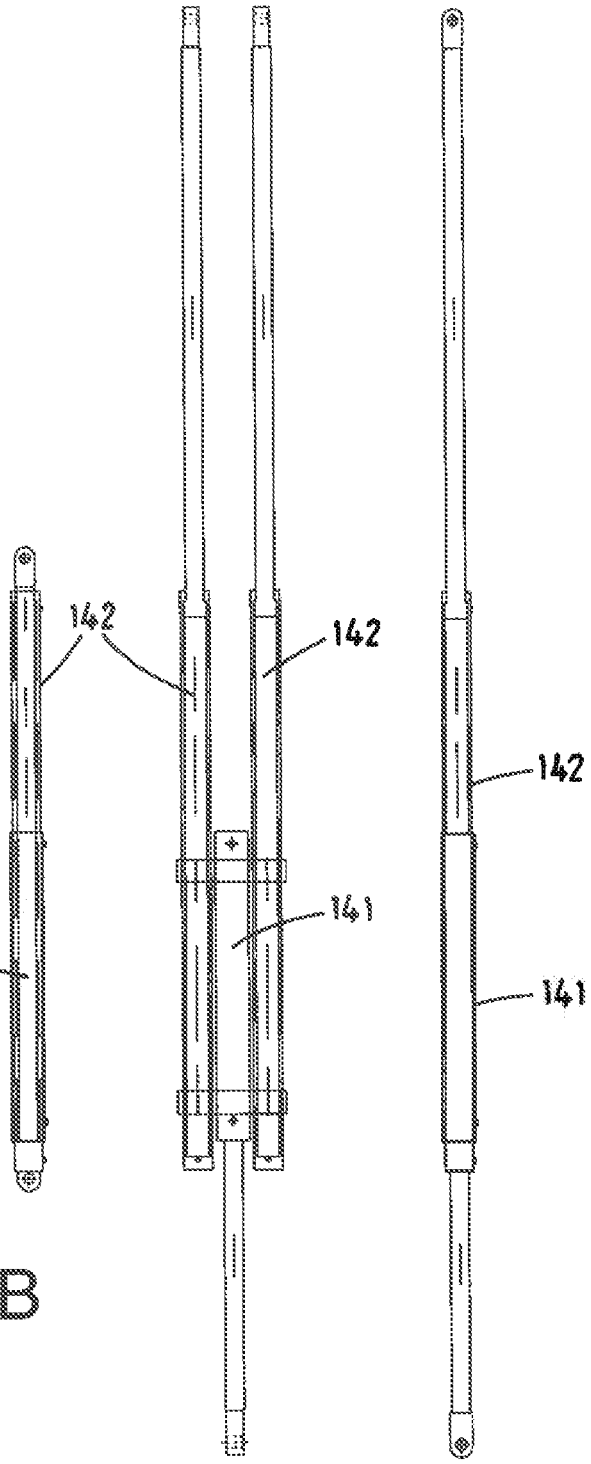

For example, as illustrated in FIGS. 9B and 9C a single lift cylinder 141 supports two heave compensation cylinders 142, e.g. the single lift cylinder 141 in between the two heave compensation cylinders 142.

As shown, for example, a working deck lift cylinder 141 is secured with the piston rod thereof directed downwards, and each heave compensation cylinder 142 is secured with its cylinder body to the cylinder body of the lift cylinder 141, e.g. via a frame, and has its piston rod directed upward to the working deck (not shown in FIGS. 9B,C).

Each of the lift cylinder 141 and heave motion compensation cylinder 142 may be embodied as a single acting hydraulic cylinder.

As is common in the field, the hydraulic heave motion compensation cylinder(s) 142 may be connected to a gas buffer, e.g. a nitrogen buffer, preferably via a medium separator as is known in the art.

The lift cylinder(s) 141 may be connected to a motorized pump that is connected to a tank containing hydraulic fluid.

The tower 30 is embodied as a vertical mast structure erected above the upper deck of the deckbox structure and adjacent a side of the moonpool 20, the vertical mast structure being located outside of the vertical projection of the moonpool 20 so as to allow for optimal movement of objects out of and into the moonpool. This in contrast to a derrick mounted with its derrick structure over the moonpool as in the mentioned Jack Bates vessel.

The mast 30 may for example have a height of 60 meters, e.g. in view of handling multi-joint drilling tubulars 165, also called stands, e.g. a stand having a length of between 25 and 35 meters, e.g. triple stands having a length of 96 ft with the working deck 100 in heave motion compensation mode or quad stand when the working deck 100 is in its lower resting position.

The vertical mast structure 30 here, as preferred, is arranged in vertical projection above the storage space 14 of the riser storage caisson 10, so as to be close to the moonpool 20 which is favorable in view of the (bending) loads on the mast structure during hoisting of objects, e.g. a riser string with BOP 85 at the lower end thereof, in the firing line 30*a*.

A crown block structure 31 is mounted on top of the vertical mast structure, e.g. supporting a set of crown block sheaves 32 that guide a winch driven cable 33 from which a travelling block 34 is suspended, the travelling block having a set of sheaves for the cable 33.

The mast structure has an operative face 35 directed towards the firing line 30*a* through the moonpool 20.

The drilling installation further comprises a firing line 30*a* associated hoisting device comprising at least one winch (e.g. accommodated in the deckbox 2 or in the mast 30) and at least one winch driven cable 33, which hoisting device is adapted to suspend a load from a crown block structure 31 via said at least one winch driven cable 33 and to manipulate a suspended load in the firing line, e.g. that extends along and outside of an operative face of the vertical mast structure.

The riser joint transfer passage 8 is arranged in proximity of the vertical mast structure 30.

In an embodiment the riser joint transfer device is embodied as a crane 60 arranged on the vertical mast structure, the crane being configured to lift and lower a riser joint through the riser joint transfer passage.

In an embodiment the crane 60 comprises a cantilevered crane arm, having an inner end connected to the tower structure, e.g. via a base that is vertically movable along a vertical rail on the tower structure. A winch driven cable may then depend, e.g. in a multi fall arrangement, from the crane arm and be provided with a riser joint connector configured to connect the cable to a riser joint 15, 16. The crane arm may be slewable about a vertical slew axis so as to move the riser joint held by this crane between a position aligned with the transfer opening 8 and a position aligned with the firing line 30*a*.

In an alternative design the vessel has a crane distinct from the drilling installation, e.g. a general purpose crane 65 onboard the vessel, that has the capability to lift and lower a riser joint 15, 16 through the riser joint transfer passage 8 and, possibly, the capability to move the riser joint between a position aligned with the transfer opening 8 and a position aligned with the firing line 30*a*.

The vertical mast structure is located in vertical projection above the storage space 14 of the riser storage caisson 10 and the riser joint transfer passage 8 is, as preferred, arranged, seen in plan view onto the upper deck, within a 90° sector of the storage caisson 10 relative to the mast, so in close proximity of the mast 30. This for example allows for optimal use of deck space without interference by the handling of the riser joints. It also allows for optimal use of space within the deckbox in the vicinity of the moonpool, e.g. for riser tensioner equipment, BOP storage, and/or coil devices.

The BOP handling rails 81, 82, e.g. on a lower or lowermost deck of the deckbox structure, are here arranged perpendicular to the operative face of a vertical mast structure of the drilling installation.

As shown here, e.g. in FIG. 8B, the BOP 85 is so tall that it sticks out of the upper deck 3 adjacent the moonpool 20 when in the storage room 80 and during transfer to the firing line 30*a* underneath the raised working deck 100.

The BOP 85, as shown here, may be composed of a lower stack assembly 85*a*, with one or more ram units, and an upper stack assembly 85*b* (often referred to as lower marine riser package). For example storage of multiple upper stack assemblies may be provided for, as shown here.

The mast structure 30 is provided, in proximity of the riser joint transfer passage 8, with a vertical motion arm assemblies rail 160, wherein at least one, here three, motion arm assemblies 161, 162, 163 are mounted on this vertical motion arm assemblies rail.

Each motion arm assembly has a base that is vertically mobile along the vertical motion arm assemblies rail and an extensible, e.g. telescopic, arm that is mounted via a vertical axis slew bearing on the base so as to allow for extension and retraction of said arm as well as slewing motion of the arm about the vertical slew axis. The arm is adapted to support a tool at an end of the arm, for example a riser joint engagement tool, e.g. said riser joint engagement tool being configured to assist in transfer of a riser joint between a position thereof aligned with the firing line and a position aligned with the riser joint transfer passage.

The riser joint transfer passage 8 is arranged is arranged here, as preferred, at one lateral side of the mast structure 30.

The vessel 1 is provided with a drilling tubulars storage rack 170, e.g. multi-joint drill pipe stands storage rack, e.g. a rotary storage rack 170. Here the rack 170 is arranged at an opposed lateral side of the mast structure relative to the passage 8.

The drilling tubulars storage rack 170 is adapted for storage of drilling tubulars in vertical orientation therein, e.g. multi-joint drilling tubulars, e.g. triples and/or quads.

The vessel 1, e.g. the mast structure 30, is provided with a racker system 180 that is adapted to move a drilling tubular between the storage rack 170 and a position aligned with the firing line 30*a*.

In an embodiment the racker system 180 comprises a vertical motion arm assemblies rail 181, wherein at least one, here multiple, motion arm assemblies 182, 183, 184 are mounted on that vertical motion arm assemblies rail.

Each motion arm assembly has a base that is vertically mobile along the vertical motion arm assemblies rail and an extensible, e.g. telescopic, arm that is mounted via a vertical axis slew bearing on the base so as to allow for extension and retraction of said arm as well as slewing motion of the arm about the vertical slew axis. The arm is adapted to support a tubulars gripper tool at an end of the arm, so as to allow for gripping of a drilling tubulars by means of the tubular gripper tool.

The vessel is provided with a mobile working deck 100 which is arranged in vertical projection above the moonpool 20. The working deck 100 may serve the purpose of drill floor in drilling operations.

The working deck 100 is movable, e.g. vertically movable. As shown here the working deck 100 is guided along one or more vertical guide rails 37 that are here mounted to the operative face 35 of the mast 30. For example, as shown here, the working deck 100 is provided with roller assemblies 106 that engage the one or more vertical guide rails 37.

As explained earlier herein, the working deck 100 may be guided over one or more vertical guide rails, e.g. on mast 30, and supported on compensator cylinders 140, e.g. on two sets of lift cylinder 141 and heave compensation cylinders 142 combined.

The mobile working deck 100, in a lower stationary resting position thereof, is flush with at least an adjoining area of the upper deck 3 of the deckbox structure. Locking devices may be provided to lock the working deck in said position relative to the deckbox structure.

As shown the working deck 100 and the adjoining area of the upper deck of the deckbox structure 2 are provided with rail tracks 110 configured to transfer equipment over the rail tracks 110, e.g. equipment arranged on a skid pallet skiddable over said rail tracks, onto and off the working deck 100.

In an embodiment the rail tracks comprise a section 110*b* that extends between the riser joint transfer passage 8 and the working deck 100. The vessel may comprise a riser joint cart that is configured to travel over this section 110*b* of the rail tracks 110 and that is configured to support a riser joint 15, 16 thereon in vertical orientation for transfer thereof between a position above the upper deck 3 and aligned with the riser joint transfer passage 8 on the one hand and a position aligned with the firing line 30*a* on the other hand. Herein the working deck 100 will be in its lowered resting position, flush with the upper deck 3. Once aligned with the firing line 30*a*, for example, the riser joint 15, 16 can then be connected to a riser lifting tool connected to the travelling block 34 and so taken over by the hoisting device so that the riser joint cart can be moved away and the riser joint connected to the upper end of the already assembled part of the riser string (which is for example held by a riser spider device arranged on the working deck 100).

As explained, in combination with the use of a riser joint cart that supports the lower end of a riser joint whilst being transferred between a position aligned with the passage 8 and a position aligned with the firing line 30*a*, an motion arm assembly, e.g. assembly 162, nay serve to engage the same riser joint at an elevated position, e.g. at or near the top, in order to keep the riser joint in vertical orientation and/or to stabilize the riser joint in vertical orientation.

The tower 30 is embodied as a vertical mast structure erected above the upper deck 3 of the deckbox structure and adjacent a side of the moonpool 20. The mast structure, e.g. at the operative face 35 thereof directed towards the firing line 30*a* through the moonpool 20, is provided with one or more vertical guide rails 37.

The depicted drilling installation comprises a travelling device 95 that is movable up and down along and outside of said operative face of the mast and guided by the one or more vertical guide rails 37 of the mast 30.

Here the travelling device 95, or trolley, is suspended from a winch driven cable 33, e.g. suspended from a crown block structure 31 of the tower via travelling block 34, e.g. the travelling device being suspended from a travelling block 34, e.g. wherein the travelling device is adapted to suspend a load from said travelling device and/or to support the travelling block.

The tower 30 here, as preferred, is embodied as a singular vertical mast structure having closed wall contour, here as preferred, an octagonal cross-section, e.g. over at least a major portion of the height of the tower.

FIGS. 10*a, b, c* illustrate a method for assembly of a riser from the vessel 1. This method comprises moving the BOP 85 from the BOP storage room 80 by means of cart 83 to a position aligned with the firing line 30*a* through the moonpool. Herein the BOP 85 sticks out above the upper deck 3 when stored, and assembled, in the BOP storage room 80. The method comprises lifting the mobile working deck 100 in order to allow for travel of the BOP 85 on the respective BOP handling cart 83 towards the moonpool 20 and underneath the raised working deck 100 into a position aligned with the firing line 30*a*.

Figure 10C:
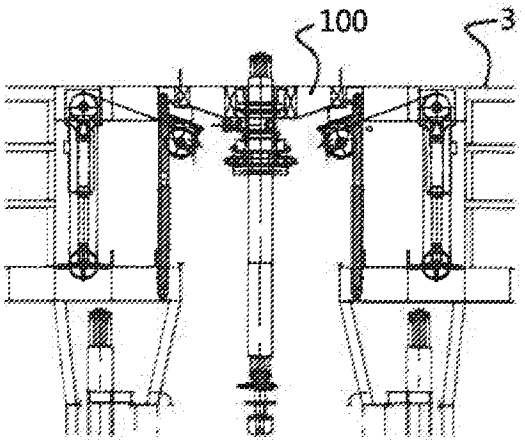

As shown in FIG. 10*a* the working deck 100 is used to retain a first riser joint 15 to be joined on top of the BOP 85. Lowering the working deck may be done in order to mate this first riser joint 15 to the BOP 85 still on cart 83. The working deck 100 is then raised by cylinders 140, 141, and/or 142, to lift the BOP 85 of the cart and the cart 83 is moved back into the storage room. This allows for lowering the working deck 100 into the lower resting position thereof as shown in FIG. 10*c* and extension of the riser by adding riser joints in a manner known in the art (e.g. the working deck supporting a riser spider device to support the riser during said assembly).

The vessel 1 further has a catwalk machine 200 that is arranged on the upper deck 3 and that is configured to feed and remove drilling tubulars to and from a stand building line 202 that is remote from the firing line 30*a* of the tower 30.

As preferred, here, the stand building line 202 is located on the rear side of the mast 30, opposite the operative side 35 of the mast 30.

As preferred a further racker system 180' is provided to serve the stand building line 202 and to transfer drilling tubulars between the stand building line 202 and the drilling tubulars storage rack 170, e.g. the rotary storage rack 170. As will be appreciated the racker system 180' preferably is embodied as disclosed with reference to racker system 180.

The vessel is provided with a top drive device 210 as commonly used in drilling operations. For example the top drive device is connected or connectable to the travelling device 95 on the tower. The top drive device 210 comprises one or more motors to provide torque to a rotary output quill that is connectable to a drilling tubulars string as is known in the art.

The vessel 1 is, as preferred, equipped with a riser tensioning buoyancy can 250, preferably an air can having compartment(s) filled with air, e.g. a controllable volume of air in order to adjust the buoyancy provided by the air can 250, that is configured to be secured to an upper portion of a subsea riser, e.g. in view of reducing the requirements of the wireline riser tensioner system of the vessel.

For example the air can 250 has an annular air can body with a central vertical bore that is adapted to receive therein a riser joint 15, 16 of the vessel 1. For example the bore has a diameter of at least 1.40 meters, e.g. between 1.40 and 2 meters.

In an embodiment the air can is cylindrical having an outer diameter between 4 and 9 meters, e.g. of 5 or 7.5 meters.

In an embodiment the air can 250 is to be installed in the riser string directly below the telescopic joint 190, e.g. over the riser joint that is mounted directly below the telescopic joint 190. In another embodiment a further BOP device is mounted directly below the telescopic joint 190, with the air can 250 being mounted directly below said further BOP device.

For example the air can 250 has a height between 15 and 25 meters, e.g. approximately 18 or 20 meters, e.g. shorter than the length of a riser joint 15, 16 stored in the carousel device 40.

For example the air can 250 is embodied to provided, when fully submerged, provide a top tension to the riser of at least 200 mt, e.g. more than 250 mt, possibly even more than 500 mt.

Preferably the vessel 1 is embodied to store the air can 250 at a location directly adjacent the moonpool 20, here close to the BOP storage room 80. For example the air can is arranged on the same deck as the BOP 85. In an embodiment the air can 250 is to be handled by a general purpose crane of the vessel 1, or in the alternative arranged on a cart that is movable over associated rail track between a storage position adjacent the moonpool 20 and a position aligned with the firing line 30*a*.

In embodiment the vessel 1, as here, has a deck in the deckbox structure 2, here the lowermost deck, whereon both the BOP 85 and an air can 250 are stored, e.g. both the BOP 85 and the air can 250 being so tall that they stick out above the upper deck 3 of the vessel 1.

As will be appreciated it is preferred for the mobile working deck 100 to be liftable to a height that allows to move the air can 250 into a position underneath the deck 100 and aligned with the firing line 30*a*.

The invention claimed is:

1. A semi-submersible drilling vessel, comprising:

a deckbox structure having an upper deck and a box bottom;

one or more pontoons;

multiple support columns extending upward from the one or more pontoons and supporting thereon the deckbox structure;

a drilling installation with a drilling tower that is erected above the upper deck of the deckbox structure, the drilling installation being adapted to perform drilling operations along at least one firing line through a moonpool; and a mobile working deck arranged, as seen in a vertical projection, above the moonpool, the working deck being vertically movable, and in a lower stationary resting position thereof being flush with an adjoining area of the upper deck, wherein, adjoining the moonpool, a subsea Blow Out Preventer (BOP) storage room is provided on a lower deck of the deckbox structure, wherein a set of BOP handling cart rails is provided extending from the subsea Blow Out Preventer storage room towards and along opposed sides of the moonpool, wherein said vessel is provided with a BOP handling cart that travels over said BOP handling cart rails and is configured to support a subsea Blow Out Preventer, wherein the mobile working deck is liftable from said lower stationary resting position thereof into an elevated position in order to allow for transfer of the subsea Blow Out Preventer by means of the BOP handling cart between the BOP storage room and a position underneath the elevated mobile working deck and aligned with the firing line, and wherein multiple vertically mounted working deck compensator cylinders are arranged between the deckbox structure and the mobile working deck supporting the mobile working deck, and wherein said working deck compensator cylinders are configured to provide a heave compensated motion of the mobile working deck relative to the deckbox structure.

2. The semi-submersible drilling vessel according to claim 1, wherein said mobile working deck and said adjoining area of the upper deck of the deckbox structure are each provided with rail tracks configured to transfer equipment over said rail tracks onto and off the mobile working deck when in the lower stationary resting position thereof.

3. The semi-submersible drilling vessel according to claim 1, wherein the mobile working deck is configured to be vertically movable within a motion range including a heave compensation motion range, and wherein at least one of a drill string slip device, a riser spider device, and a diverter is supported by the mobile working deck.

4. The semi-submersible drilling vessel according to claim 1, wherein a first set of working deck compensator cylinders is arranged outward of a first BOP handling cart rail of said set of BOP handling cart rails, relative to the moonpool, and wherein a second set of working deck compensator cylinders is arranged outward of a second BOP handling cart rail of said set of BOP handling cart rails, relative to the moonpool, so as to allow for passing a subsea Blow Out Preventer on the BOP handling cart in between the first and second set of working deck compensator cylinders.

5. The semi-submersible drilling vessel according to claim 4, wherein a first set of vertically oriented wireline riser tensioner cylinders is arranged outward of the first set of working deck compensator cylinders, relative to the moonpool, and wherein a second set of vertically oriented wireline riser tensioner cylinders is arranged outward of the second set of working deck compensator cylinders, relative to the moonpool.

6. The semi-submersible drilling vessel according to claim 1, wherein each working deck compensator cylinder comprises in series:

a lift cylinder configured to lift the mobile working deck out of the stationary resting position and to move the mobile working deck between the lowered position and the elevated position; and a heave compensation cylinder configured to provide the heave compensated motion of the mobile working deck when lifted in the elevated position by the lift cylinder, allowing for motion of the mobile working deck between a heave compensation maximum height position and a heave compensation minimum height position.

7. The semi-submersible according to claim 1, wherein the multiple vertically mounted working deck compensator cylinders are each secured at a lower end thereof to said lower deck of the deckbox structure.

8. The semi-submersible drilling vessel according to claim 1, wherein the vessel is provided with a drilling tubulars storage rack mounted on the deckbox structure, the drilling tubulars storage rack being adapted for storage of drilling tubulars in a vertical orientation therein, wherein the vessel is provided with a racker system adapted to move a drilling tubular between the storage rack and a position aligned with the firing line, and wherein the racker system is heave compensated and is configured to bring a drilling tubular removed from the storage rack in a heave compensation motion that is synchronized with the heave compensation motion of the mobile working deck.

9. The semi-submersible drilling vessel according to claim 8, wherein the racker system comprises a vertical motion arm assemblies rail, wherein at least one motion arm assembly is mounted on said vertical motion arm assemblies rail, each motion arm assembly having a base vertically mobile along said vertical motion arm assemblies rail by a drive configured to provide said heave compensation motion synchronized with the heave compensation motion of the mobile working deck, each motion arm assembly further having an extensible arm mounted via a vertical axis slew bearing on said base so as to allow for extension and retraction of said arm as well as slewing motion of said telescopic arm about said vertical slew axis, and wherein said arm is adapted to support a tubulars gripper tool at an end of said arm, so as to allow for gripping of a drilling tubulars by the tubular gripper tool.

10. The semi-submersible drilling vessel according to claim 1, wherein the tower is embodied as a vertical mast structure erected above the upper deck of the deckbox structure and adjacent a side of the moonpool, the vertical mast structure being located outside of a vertical projection of the moonpool, wherein a crown block structure is mounted on top of the mast structure, and wherein the mast structure has an operative face directed towards the firing line through the moonpool, and wherein the drilling installation further comprises a hoisting device comprising at least one winch and at least one winch driven cable, the hoisting device being adapted to suspend a load from said crown block structure via said at least one winch driven cable and to manipulate said suspended load in the firing line that extends along and outside of said operative face of the mast structure.

11. The semi-submersible drilling vessel according to claim 10, wherein the BOP cart rails are, seen in vertical projection, arranged perpendicular to the operative face of the mast structure.

12. The semi-submersible drilling vessel according to claim 1, wherein the deckbox structure comprises, adjoining the moonpool, a spoolable product coil devices room accommodating therein one or more coil devices, each having a coil storing thereon a spoolable product, and wherein the spoolable product coil devices room is open towards the moonpool, allowing to pass the spoolable product from the respective coil device towards the firing line.

* * * * *